US009809921B2

(12) United States Patent
Jo et al.

(10) Patent No.: US 9,809,921 B2
(45) **Date of Patent: *Nov. 7, 2017**

(54) DETERGENT DISPENSER FOR WASHING MACHINE

(71) Applicant: LG ELECTRONICS INC., Seoul (KR)

(72) Inventors: Mingyu Jo, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/616,771

(22) Filed: Jun. 7, 2017

(65) Prior Publication Data

US 2017/0268153 A1 Sep. 21, 2017

Related U.S. Application Data

(63) Continuation of application No. 14/555,891, filed on Nov. 28, 2014.

(30) Foreign Application Priority Data

Nov. 28, 2013 (KR) ..... 10-2013-0146013
Nov. 28, 2013 (KR) ..... 10-2013-0146014

(51) Int. Cl.
*D06F 39/02* (2006.01)
*D06F 25/00* (2006.01)
*D06F 39/12* (2006.01)

(52) U.S. Cl.
CPC ..... *D06F 39/02* (2013.01); *D06F 25/00* (2013.01); *D06F 39/12* (2013.01)

(58) Field of Classification Search
None
See application file for complete search history.

(56) References Cited

U.S. PATENT DOCUMENTS 7,219,517 B2 5/2007 Maeng
2004/0000177 A1 1/2004 Maeng
(Continued)

FOREIGN PATENT DOCUMENTS

CN 201738147 U 2/2011
CN 201896256 U 7/2011
(Continued)

OTHER PUBLICATIONS

European Search Report dated May 4, 2015 issued in Application No. 14195193.9.
(Continued)

*Primary Examiner* — Michael Barr
*Assistant Examiner* — Rita Adhlakha
(74) *Attorney, Agent, or Firm* — Dentons US LLP

(57) ABSTRACT

A washing machine includes a cabinet, a tub provided within the cabinet, a drum rotatably provided within the tub, an air supply device provided on the upper surface of the tub and circulating air to the center of the front portion of the tub, a detergent dispenser located above the front portion of the tub and separating a detergent part to input detergents and a subsidiary detergent part to input subsidiary detergents, and a dispenser cover opening and closing the upper surface of the detergent dispenser.

22 Claims, 23 Drawing Sheets

(56) References Cited

U.S. PATENT DOCUMENTS

| | | | | |
|---|---|---|---|---|
| 2004/0154346 | A1 | 8/2004 | No et al. | |
| 2009/0293202 | A1 | 12/2009 | Bolduan et al. | |
| 2012/0096901 | A1* | 4/2012 | Zattin | D06F 39/02 68/13 R |
| 2013/0327101 | A1* | 12/2013 | Leibman | D06F 71/10 68/17 R |

FOREIGN PATENT DOCUMENTS

| | | | |
|---|---|---|---|
| DE | 3136768 | C2 | 3/1983 |
| DE | 103 55 451 | A1 | 6/2005 |
| DE | 10 2006 029 953 | A1 | 1/2008 |
| EP | 0 125 627 | A2 | 11/1984 |
| FR | 2 512 854 | A1 | 3/1983 |
| JP | 9-139582 | A | 5/1997 |
| JP | 2005-514134 | A | 5/2005 |
| JP | 2005-137944 | A | 6/2005 |
| JP | 2005-334118 | A | 12/2005 |
| JP | 2013-85873 | A | 5/2013 |
| KR | 10-2003-0061187 | A | 7/2003 |
| KR | 10-2003-0061193 | A | 7/2003 |
| KR | 10-2010-0081235 | A | 7/2010 |
| KR | 10-2010-0124128 | A | 11/2010 |
| WO | WO 03/057970 | A1 | 7/2003 |
| WO | 2007/124813 | A1 | 11/2007 |
| WO | WO 2013/032224 | A2 | 3/2013 |

OTHER PUBLICATIONS

European Search Report dated May 7, 2015 issued in Application No. 14195221.8.

International Search Report dated Feb. 16, 2015 issued in Application No. PCT/KR2014/011484 (Full English Text).

International Search Report dated Mar. 9, 2015 issued in Application No. PCT/KR2014/011491 (Full English Text).

* cited by examiner

A ~ A'

C - C'

DETERGENT DISPENSER FOR WASHING MACHINE

CROSS-REFERENCE TO RELATED APPLICATION

This application is a continuation application of U.S. patent application Ser. No. 14/555,891 filed Nov. 28, 2014, which claims the benefit of Korean Patent Application No. 10-2013-0146013 filed on Nov. 28, 2013 and Korean Patent Application No. 10-2013-0146014 filed on Nov. 28, 2013, all of which are hereby incorporated by reference in their entirety for all purposes as if fully set forth herein.

BACKGROUND

1. Field

The present disclosure relates to a washing machine having a detergent dispenser and a dispenser cover to open and close the detergent dispenser.

2. Background

In general, washing machines include dryers drying laundry and washers washing laundry. Among these washing machines, a washer uses detergents to wash laundry and thus generally includes a detergent dispenser to input detergents. Therefore, a detergent dispenser is essential in washers.

As exemplarily shown in FIG. 1, a washing machine 10 includes a cabinet 11 forming the external appearance of the washing machine 10, a tub (not shown) provided within the cabinet 11 and storing wash water, and a drum 12 rotatably provided within the tub and receiving and washing laundry. The washing machine 10 includes a detergent dispenser 20 into which detergents are input into improve washing effects of laundry washed by the drum 12.

The detergent dispenser 20 includes a drawer-type detergent container 21 partially withdrawn forwards from the washing machine 10. Detergents are provided into the withdrawn detergent container 22 and then the detergent container 22 is inserted into the detergent dispenser 20. The detergent dispenser 20 includes the detergent container 22 into which detergents are provided, and the detergents together with wash water are supplied to a space for washing, i.e., the tub or the drum 12. When detergents are provided into the detergent dispenser 20, the withdrawn state of the detergent dispenser 20 in the forward direction of the washing machine 10 is maintained and a user pours detergents to the detergent dispenser 20.

When a user provides detergent to the detergent dispenser 20 while holding a detergent container, the user may exert considerable effort and may be inconvenienced or hurt. When a user pours detergent to the detergent dispenser with a discharge hole of the detergent container resting on the detergent dispenser 20, the detergent dispenser 20 may be damaged by load of the detergent container. Further, when the detergent dispenser 20 needs to be withdrawn in the forward direction of the washing machine 10, the detergent dispenser 20 needs to be formed on the front surface of the washing machine 10, which restricts the front design of the washing machine 10.

BRIEF DESCRIPTION OF THE DRAWINGS

The embodiments will be described in detail with reference to the following drawings in which like reference numerals refer to like elements wherein.

DETAILED DESCRIPTION

Figure 1:
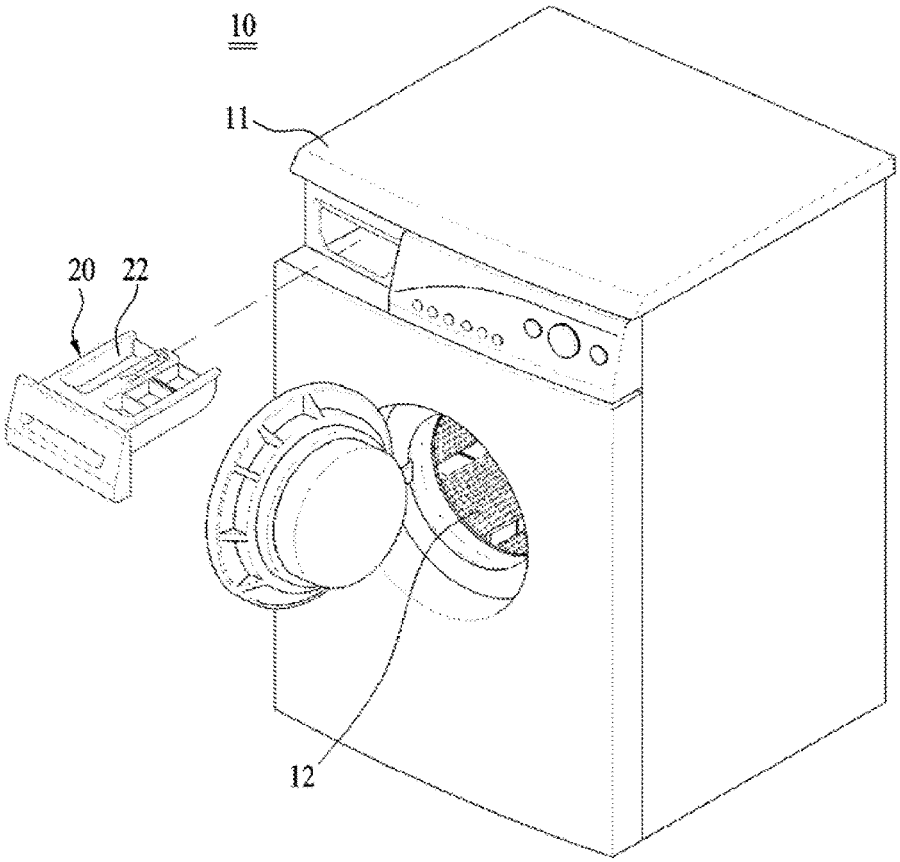
PRIOR ART FIG. 1
FIG. 1 is a perspective view illustrating a conventional washing machine.
Figure 2:
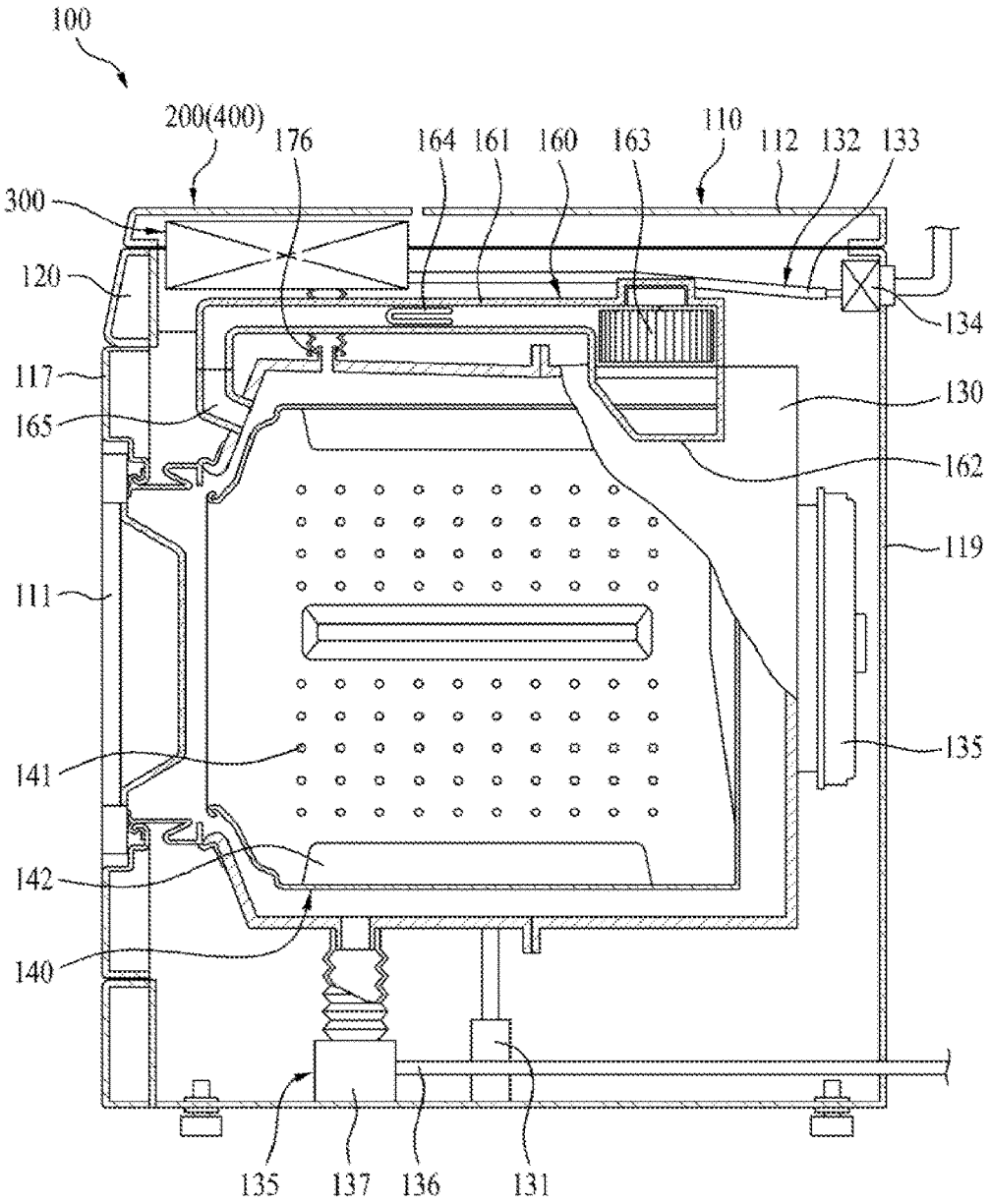
FIG. 2 is a cross-sectional view illustrating a washing machine in accordance with one embodiment of the present disclosure in brief.
Figure 3:
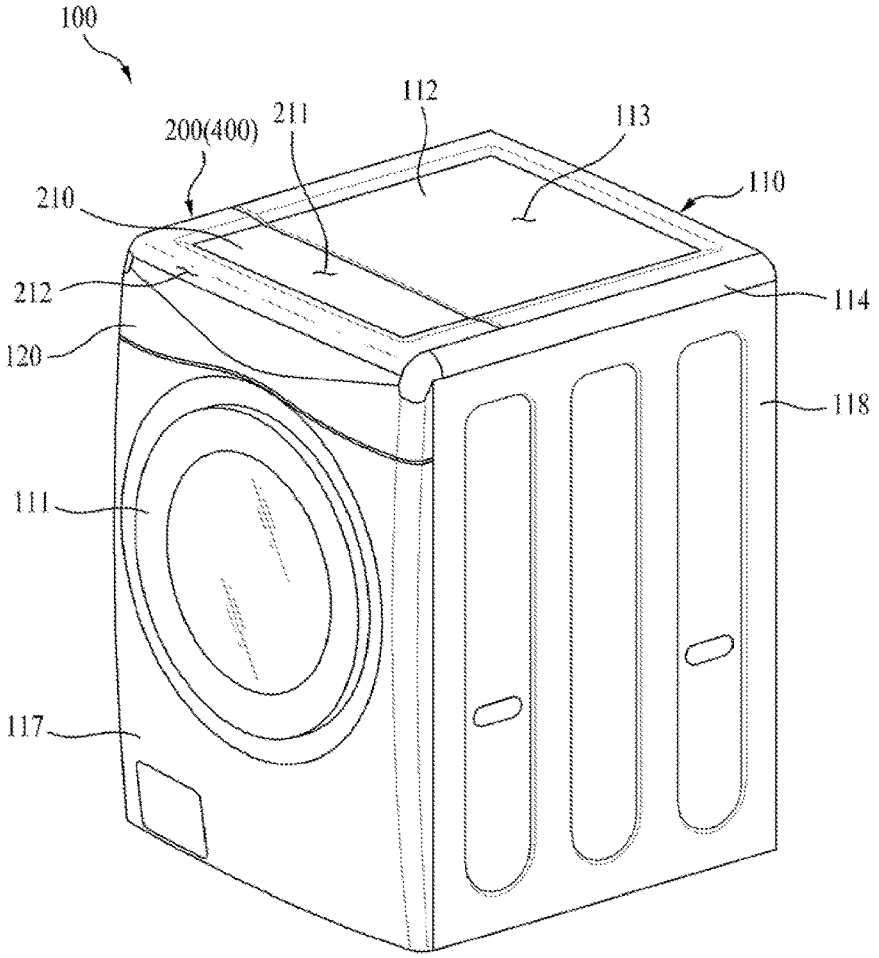
FIG. 3 is a perspective view illustrating the washing machine in accordance with the embodiment of the present disclosure.

As shown in FIGS. 2 and 3, a washing machine 100 in accordance with one embodiment of the present disclosure includes a cabinet 110 including an upper cover 112, a front cover 117, side covers 118, and a rear cover forming the external appearance of the washing machine 100. A tub 130 is provided within the cabinet 110 and stores wash water. A drum 140 is rotatably mounted within the tub 130, and an air supply device 160 heats and circulates air within the tub 130. A detergent dispenser 300 is located at the front portion of a region above the tub 130 and exposed from the front cover 112 so that detergents may be provided into the detergent dispenser 300. A dispenser cover 200 or 400 forms a surface extending to the upper cover 112 and covers the detergent dispenser 300.

The detergent dispenser 300 is mounted at the upper portion of the cabinet 110 so as to be exposed to the outside according to opening and closing of a part of the upper portion of the cabinet 110. For this purpose, the upper portion of the cabinet 110 is formed by the upper cover 112 forming a part of the upper surface of the cabinet 110 and the dispenser cover 200 or 400 shielding and exposing the detergent dispenser 300. The dispenser cover 200 or 400 forms both the upper surface of the cabinet 110 and the front edge of the upper surface of the cabinet 110. The detergent dispenser 300 and the dispenser cover 200 or 400 will be described in detail later after description of the washing machine 100.

Further, the door 111 opening and closing the inside of the cabinet 110 is mounted at the front portion of the cabinet 110. A control panel 120 to input a specific course performing operations is installed at the upper portion of the front surface of the cabinet 110. The control panel 120 includes an operation unit allowing a user to select one of washing to drying operations and a display unit displaying the operation selected by the user and the operating process of the washing machine 100.

In order to increase strength of the upper cover 112 of the cabinet 110, a depression surface 113 is formed at the inner portion of the upper cover 112. A pair of side panels 114 to cover spaces between the upper cover 112 and both side covers 118 is formed at both sides of the upper cover 112.

The tub 130 is provided within the cabinet 110 so as to store wash water, and a motor 150 to rotate the drum 140 is mounted at the rear portion of the tub 130. Further, springs and a damper 131 supporting the tub 130 so as to absorb impact applied to the tub 130 are provided between the tub 130 and the cabinet 110.

A water supply unit 132 including water supply valves 134 for at least one of hot water or cold water and water supply hoses 133 to supply wash water to the tub 130. A drain unit 136, including a drain pump 138 and a drain hose 137 to drain wash water in the tub 130 after washing of laundry are provided on the tub 130.

A hot water supply line 135*d* is connected to the water supply valve 134 to supply hot water. Further, a 3-way valve to selectively supply cold water may be used as the water supply valve 134 to supply cold water. Here, first and second water supply lines 135*a* and 135*b* and a preliminary water supply line 135*c* are connected to the 3-way valve 134 to supply cold water.

Further, all the above-described first and second water supply lines 135*a* and 135*b*, preliminary water supply line 135*c*, and hot water supply line 135*d* are connected to the detergent dispenser 300, and may supply water directly to the tub 130 through the detergent dispenser 300 or mix supplied wash water with a liquid/powder detergent, a preliminary detergent, a bleaching agent and a fabric softener and supply the liquid/powder detergent, preliminary detergent, bleaching agent and fabric softener mixed with wash water to the tub 130. The functions of the first and second water supply lines 135*a* and 135*b*, the preliminary water supply line 135*c*, and the hot water supply line 135*d* will be described in detail in conjunction with description of the detergent dispenser 300.

The drum 140 is rotatably provided within the tub 130, and laundry input through the door 111 is loaded in the drum 140. A plurality of holes 141 through which wash water passes are formed on the drum 140 and lifters 142 for tumbling the laundry when the drum 140 is rotated are formed on the inner surface of the drum 140. Washing performance may be improved according to movement of laundry by the lifters 142.

The air supply device 160 heats air in the tub 130 and circulates the heated air in the tub 130, thus drying laundry located in the drum 140 during a drying cycle. The air supply device 160 includes an intake part 162 through which air in the tub 130 is introduced into the air supply device 160, an air blower fan 163 located above the intake part 162 and sucking in the air, a heater 164 heating the air sucked in by the air blower fan 163, and an exhaust part 165 supplying the air heated by the heater 164 to the inside of the drum 140.

The intake part 162 may be located on the outer circumferential surface of one side of the rear portion of the tub 130 so that air in the tub 130 is introduced directly into the intake part 162, and the exhaust part 165 is connected to the center of the front portion of the tub 130 so that air is exhausted directly to the inside of the drum 140. A duct 161 forming a movement path of air is provided between the intake part 162 and the exhaust part 165, and the heater 164 and the air blower fan 163 may be located within the duct 161. The duct 161 is connected from the intake part 162 to the exhaust part 165 and has a shape extending from one side of the rear portion of the tub 130 to the center of the front portion of the tub 130.

In terms of flow of air, air exhausted from the air blower fan 163 may be heated by the heater 164. The air supply device 160 of the present disclosure may have a structure in which air is directly sucked in through the outer circumferential surface of the tub 130 and heated and the heated air is supplied to the front portion of the tub 130, and humid air after drying of laundry may be condensed on the inner surface of the tub 130 due to a temperature difference between the inside of the tub 130 and the outside of the tub 130 and be converted into dry air. Alternatively, in order to convert humid air after drying of laundry into dry air, a part of humid air within the tub 130 may be discharged to the outside of the tub 130 and a part of dry air at the outside of the tub 130 may be introduced into the tub 130.

In operation, wash water is introduced into the tub 130 through the water supply unit 132 and washing, rinsing, and dehydrating are performed by rotation of the drum 140. During washing and rinsing, wash water is discharged to the outside of the tub 130 through the drain unit 136. After washing and rinsing, dehydrating of laundry is carried out to complete the operation. If drying is carried out, air in the tub 130 is circulated by the air blower fan 163 of the air supply device 160 and the heater 164 of the air supply device 160 heats the air. The heated air is circulated in the tub 130 and the air supply device 160 and thus dries laundry loaded in the drum 140. Air having dried the laundry is condensed on the inner circumferential surface of the tub 130 due to a temperature difference between the inside and the outside of the tub 130 and is drained to the outside of the tub 130 by the drain unit 136.

Detergents to wash laundry need to be provided into the washing machine 100 prior to or during operation of the above-described washing machine 100. The dispenser cover 200 or 400 provided at the upper portion of the washing machine 100 is opened so that a liquid detergent, a powder detergent, a fabric softener, a subsidiary detergent, etc. are selectively provided or poured into the detergent dispenser 300.

Figure 4:
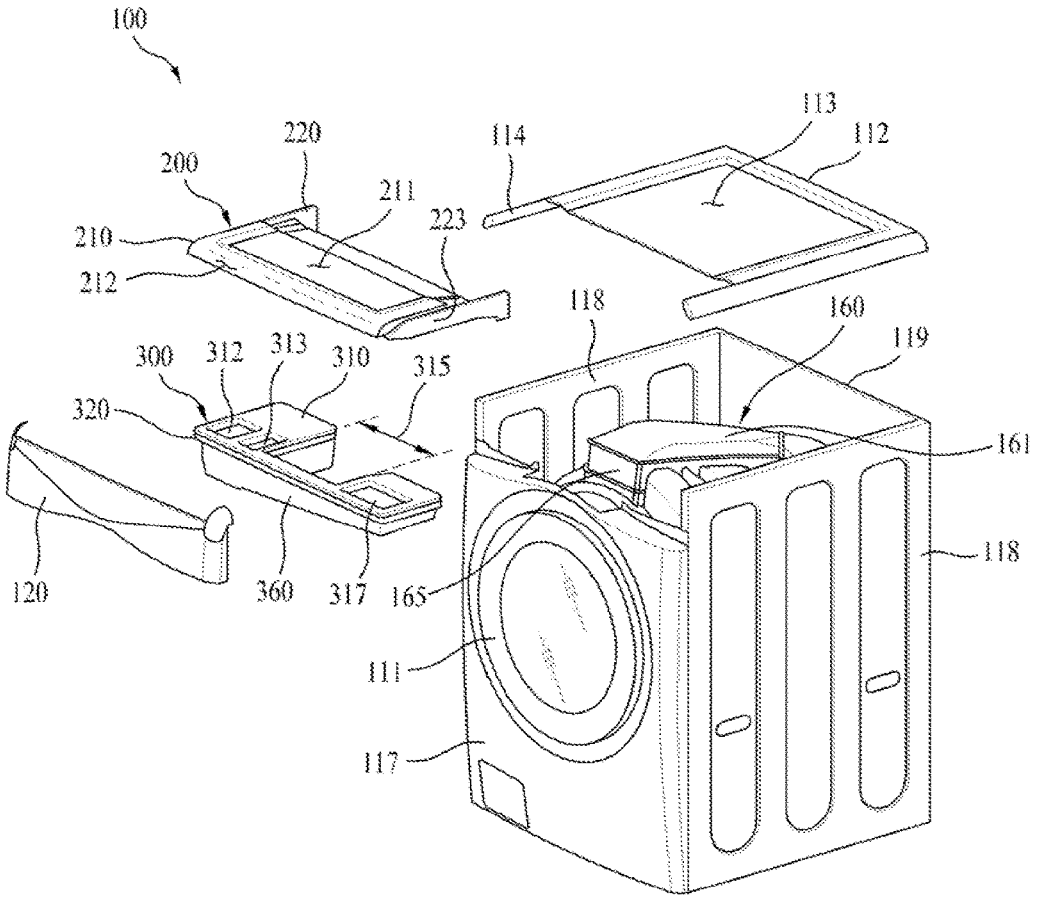
FIG. 4 is an exploded perspective view illustrating the upper structure of the washing machine in accordance with the embodiment of the present disclosure.
Figure 5:
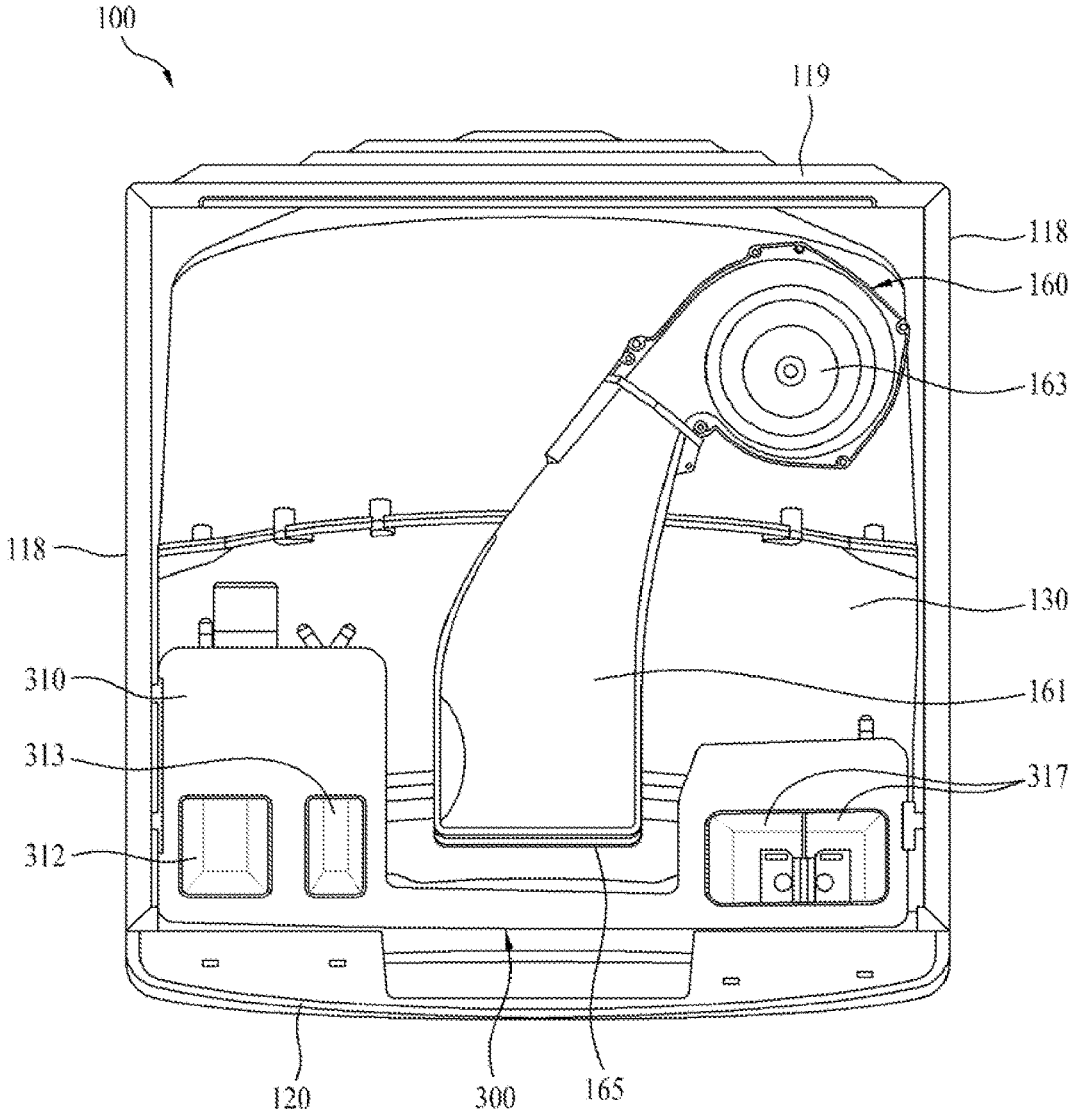
FIG. 5 is a plan view illustrating the inner structure of the washing machine in accordance with the embodiment of the present disclosure.

As shown in FIGS. 4 and 5, the detergent dispenser 300 is located on the upper surface of the front region of the tub 130 within the cabinet 110 and exposed to the outside according to opening of the dispenser cover 200. The detergent dispenser 300 is installed at the upper portion of the cabinet 110 and includes a lid 310, a flow path unit 320, and a collector unit 360. The detergent dispenser 300 has a plurality of input holes 312, 313, and 317 to input a liquid/powder detergent, a preliminary detergent, a fabric softener, a subsidiary detergent, etc.

The detergent dispenser 300 also includes a detergent supply hose connected to the tub 130 so that the liquid/powder detergent, the preliminary detergent, the fabric softener, the subsidiary detergent, etc., which are selectively input, are mixed with separately supplied wash water and then supplied to the tub 130.

The exhaust part 165 of the above-described air supply device 160 is located above the front portion of the tub 130 and the duct 161 of the air supply device 160 has a shape extending from one side of the rear portion of the tub 130 to the exhaust part 165.

Therefore, in order to avoid interference between the detergent dispenser 300 and the exhaust part 165 or the duct 161 of the air supply device 160, input hole is not formed at the central portion of the detergent dispenser 300 (more particularly, the portion of the detergent dispenser 300 above the exhaust part 165 of the air supply device 160) and duct space parts 315, in which the front end of the duct 161 and the discharge part 165 of the air supply device 160 are located, are formed at the central portion of the detergent dispenser 300.

The duct space parts 315, in which the front end of the duct 161 and the discharge part 165 of the air supply device 160 are located, are formed at the central portion of the detergent dispenser 300, and the input holes 312, 313, and 317 to receive a liquid/powder detergent, a preliminary detergent, a fabric softener, a subsidiary detergent, etc. are separately located at one side and the other side of the detergent dispenser 300. The input holes 312 and 313 to input a liquid/powder detergent and a preliminary detergent may be located at one side of the detergent dispenser 300 and the input hole 317 to receive a fabric softener and a subsidiary detergent is located at the other side of the detergent dispenser 300.

Although one side and the other side of the detergent dispenser 300 may be installed so as to be separated from each other, both sides of the detergent dispenser 300 may be formed integrally for convenience of installation and configured such that wash water supplied from one side (or the other side) of the detergent dispenser 300 may be supplied to the other side (or one side) of the detergent dispenser 300. The detergent dispenser 300 will be described in detail after description of the washing machine 100.

The dispenser cover 200 or 400 is provided at the front portion of the upper surface of the washing machine (more particularly, above the detergent dispenser 300) so as to open and close the front portion of the upper surface of the washing machine 100.

Further, the dispenser cover 200 or 400 and the upper cover 112 may form the upper surface of the washing machine 100 and have the same extending surface, thus forming unification. That is, the dispenser cover 200 or 400 adjacent to the upper cover 112 forms an extension surface extending to the upper surface of the upper cover 112.

The dispenser cover 200 or 400 forms the front portion of the upper surface of the washing machine 100 and extends to the front cover 117 of the washing machine 100. Since the dispenser cover 200 or 400 not only forms a part of the upper surface of the washing machine 100 but also has a connection surface 212 extending to the front cover 117 of the washing machine 100, the upper and front surfaces of the washing machine 100 are smoothly connected by the connection surface 212.

The side panels 114 located at both sides of the upper cover 112 extend from both sides of the upper cover 112 to the dispenser cover 200 and thus finish both sides of the upper cover 112 and the dispenser cover 200. The structure of the dispenser cover 200 or 400 will be described in detail after description of the detergent dispenser 300.

Figure 6:
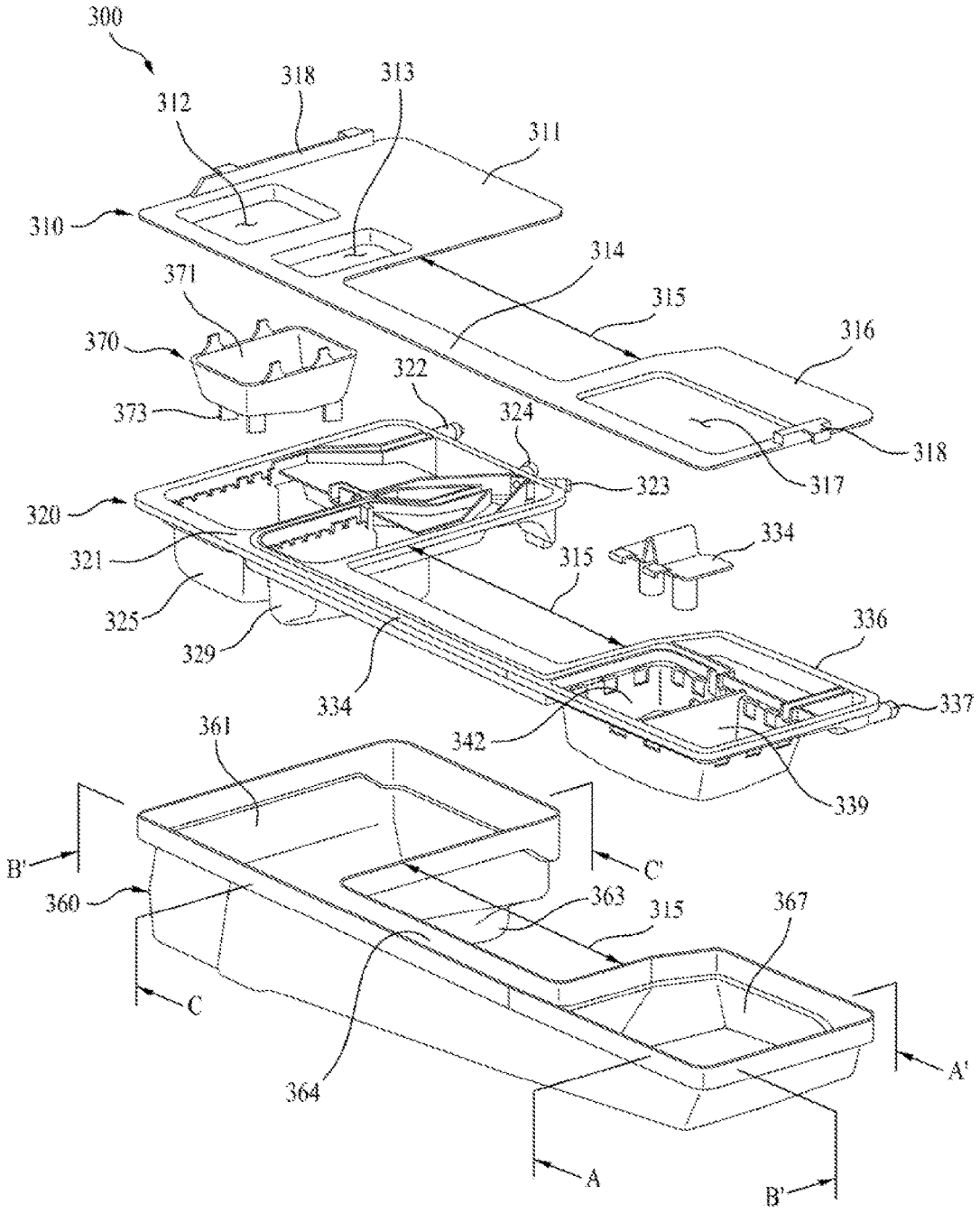
FIG. 6 is an exploded perspective view illustrating a detergent dispenser of a washing machine in accordance with one embodiment of the present disclosure.
Figure 7:
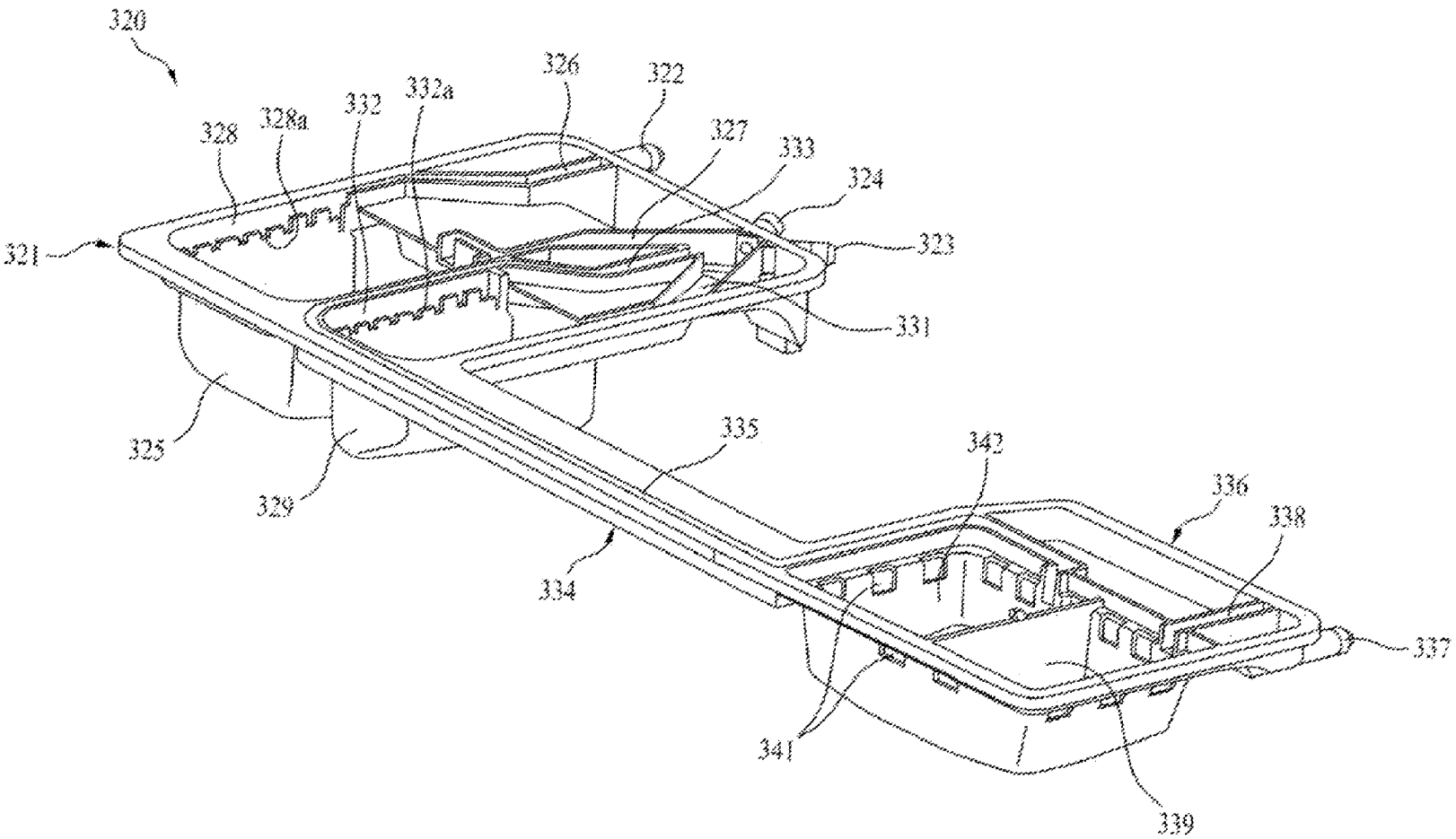
FIG. 7 is a perspective view illustrating a flow path unit of the detergent dispenser in accordance with the embodiment of the present disclosure.
Figure 8:
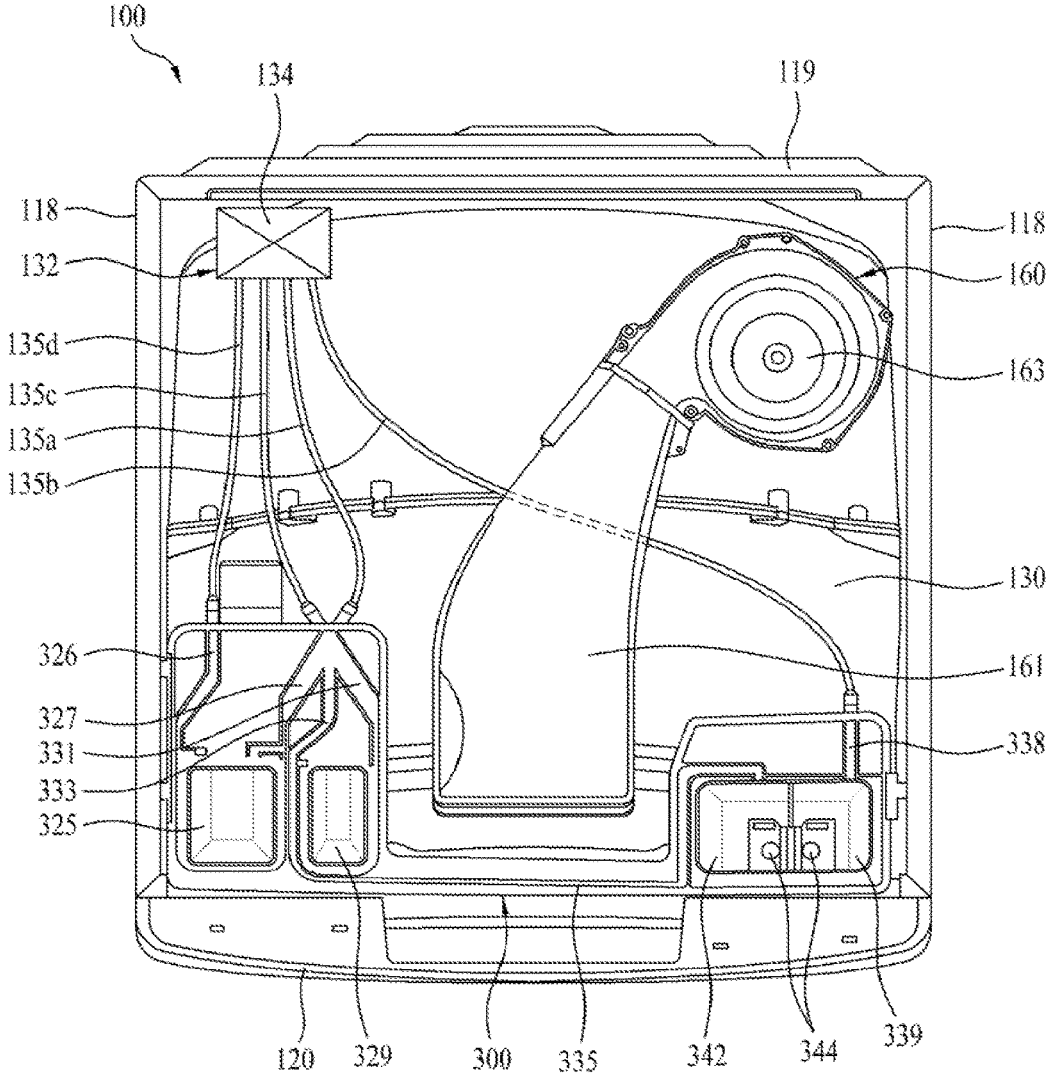
FIG. 8 is a plan view illustrating flow path connection of the detergent dispenser in accordance with the embodiment of the present disclosure.

As shown in FIGS. 6 to 8, a detergent dispenser 300 in accordance with one embodiment of the present disclosure includes a lid 310, a flow path unit 320, and a collector unit 360, which are combined so as to overlap. The lid 310, the flow path unit 320, and the collector unit 360 may be individually manufactured and then combined integrally by thermal fusion.

The lid 310 includes a detergent lid 311, a connection lid 314, and a subsidiary detergent lid 316. The flow path unit 320 includes a detergent flow path or part 321, a connection flow path or part 334, and a subsidiary detergent flow path or part 336. The collector unit 360 includes a detergent collector 361, an inclined flow path 364, and a subsidiary detergent collector 367.

In order to avoid interference with the duct 161 and the exhaust part 165 of the above-described air supply device 160, the duct space part 315 into which the duct 161 and the exhaust part 165 of the air supply device 160 are inserted is formed at the center of the rear portion of each of the lid unit 310, the flow path unit 320, and the collector unit 360. The duct space parts 315 are commonly formed at the lid unit 310, the flow path unit 320, and the collector unit 360 and serve as a criterion to divide the lid unit 310, the flow path unit 320, and the collector unit 360.

If the detergent dispenser 300 is divided by the duct space parts 315, input positions of a liquid/powder detergent, a preliminary detergent, a bleaching agent, a fabric softener, etc. may be provided at one side and the other side of the detergent dispenser 300, which are divided by the duct space parts 315.

A detergent input hole 312 and a detergent input box 325 into which a liquid/powder detergent is provided and a preliminary detergent input hole 313 and a preliminary detergent input box 329 into which an additional preliminary detergent is provided may be located at one side of the detergent dispenser 300 A subsidiary detergent input hole 317, a fabric softener input box 342 and a bleaching agent input box 339 may be located at the other side of the detergent dispenser 300. Because a user may clearly discern the divided input positions of a detergent and a subsidiary detergent, user convenience may be increased.

The lid 310 is combined with the upper portion of the flow path unit 320 and forms the upper portions of flow paths formed in the flow path unit 320. The detergent lid 311 covers the upper portion of the detergent part 321 of the flow path unit 320, the connection lid 314 covers the upper portion of the connection part 334 of the flow path unit 320, and the subsidiary detergent lid 316 covers the subsidiary detergent part 336 of the flow path unit 320.

Although the detergent lid 311, the connection lid 314, and the subsidiary detergent lid 316 of the lid unit 310 may be formed separately, they may also be formed integrally. The above-described duct space part 315 is provided between the detergent lid 311 and the subsidiary detergent lid 316. The detergent lid 311 and the subsidiary detergent lid 316 are connected by the connection lid 314.

The detergent input hole 312 into which a detergent is provided and the preliminary detergent input hole 313 into which an additional preliminary detergent is provided are formed on the detergent lid 311. Further, the subsidiary detergent input hole 317 into which a bleaching agent and a fabric softener are provided is formed on the subsidiary detergent lid part 316.

Couplers or coupling parts 318 fix the detergent dispenser 300 to the cabinet 110 after combination of the lid unit 310, the flow channel unit 320, and the collector unit 360. The coupling parts 318 are formed at the outer surfaces of the detergent lid part 311 and the subsidiary detergent lid part 316.

As shown in FIGS. 6 and 7, detergent and preliminary detergent with supplied wash water are mixed in the detergent tray or part 321 to supply the detergent and preliminary detergent mixed wash water. The connection part 334 guides a part of wash water supplied from the detergent part 321 to the subsidiary detergent tray or part 336. The bleaching agent or fabric softener is mixed with wash water supplied through the connection part 334 in the subsidiary detergent tray or part 336 to supply the mixed bleaching agent or fabric softener.

The detergent input box or well 325 into which a liquid detergent or a powder detergent is provided and the preliminary detergent input box or well 329 into which a preliminary detergent is provided are formed at the detergent part 321. The lower portions of the detergent input box 325 and the preliminary detergent input box 329 are inclined downward toward the rear portion of the flow path unit 320 and the rear portions of the detergent input box 325 and the preliminary detergent input box 329 are opened so that the input detergents together with wash water may move to the detergent collector well or part 361 of the collector unit 360.

A first circulation flow path or channel 328 is formed on the outer circumferential surface of the upper portion of the detergent input box 325 so that supplied wash water may be uniformly introduced into the detergent input box 325. A plurality of overflow projections 328*a* (through which wash water passing through the first circulation flow path 328 may overflow over the outer circumferential surface and into the detergent input box 325) is formed on the inner circumferential surface of the first circulation flow path 328. The overflow projections 328*a* may be formed at different heights in the movement direction of wash water moving along the first circulation flow path 328.

Further, a second circulation flow path or channel 332 is formed on the outer circumferential surface of the upper portion of the preliminary detergent input box 329 so that supplied wash water may be uniformly introduced into the preliminary detergent input box 329. A plurality of overflow projections 332*a* (through which wash water passing through the second circulation flow path 332 may overflow over the outer circumferential surface and into the preliminary detergent input box 329) is formed on the inner circumferential surface of the second circulation flow path 332. The overflow projections 332*a* may be formed at different heights in the movement direction of wash water moving along the second circulation flow path 332.

A plurality of connection parts or inlets 322, 323, and 324 is provided at the rear portion of the detergent part 321 to supply wash water to the detergent input box 325, the preliminary detergent input box 329, and the fabric softener input box 342. A hot water supply line connection part or inlet 322 may be coupled to supply hot water to the detergent input box 325. A first water supply line connection part or inlet 323 may be coupled to supply cold water to the detergent input box 325. A preliminary water supply line connection part or inlet 324 may be coupled to supply wash water to the preliminary detergent input box 329 together with wash water of the first water supply line 135*a* if the preliminary water supply line 135*c* supplies wash water simultaneously with the first water supply line 135*a*.

A hot water flow path or channel 326 is connected to one side of the first circulation flow path 328 and forms a flow path of hot water from the hot water supply line connection part 322 coupled to the hot water supply line 135*d*. Hot water supplied through the hot water supply line 135*d* is supplied to the first circulation flow path 328 through the hot water supply line connection part 322 and the hot water flow path 326 and supplied to the detergent input box 325 through the overflow projections 328*a* formed on the first circulation flow path 328 (see, e.g., FIG. 9).

A first water supply flow path or channel 327 is connected to the other side of the first circulation flow path 328 and forms a flow path of wash water supplied from the first water supply line 135*a*. A preliminary water supply flow path or channel 331 forms a flow path of wash water supplied from the preliminary water supply line 135*c*, which is coupled to the preliminary water supply line connection part or inlet 324.

The first water supply flow path 327 and the preliminary water supply flow path 331 are formed so as to intersect at a designated angle. A subsidiary detergent part water supply flow path or channel 333 (guiding wash water to the fabric softener input box 342) is formed in a central intersection between the water supply directions of the first water supply flow path 327 and the preliminary water supply flow path 331.

Figure 9:
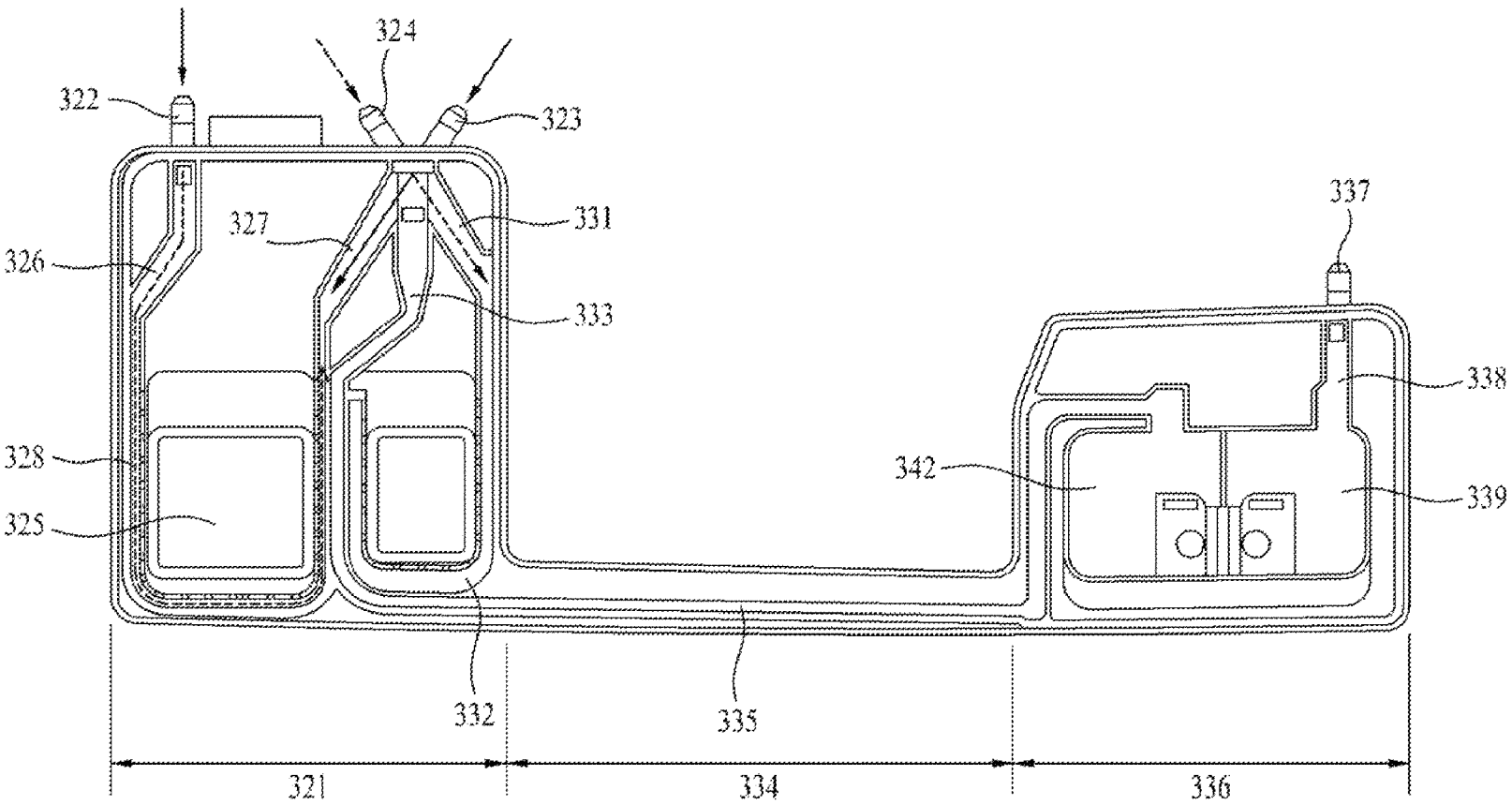
FIGS. 9 and 10 are schematic views illustrating supply of wash water by the detergent dispenser in accordance with the embodiment of the present disclosure.

Wash water supplied through the first water supply line 135*a* is supplied to the other side of the first circulation flow path 328 through the first water supply line connection part 323 and the first water supply flow path 327 and supplied to the detergent input box 325 through the overflow projections 328*a* formed on the first circulation flow path 328 (see, e.g., FIG. 9).

Hot water supplied from the hot water supply line 135*d* and wash water supplied from the first wash water supply line 135*a* may be simultaneously or selectively supplied to the first circulation flow path 328 of the detergent input box 325 through the hot water supply flow path 326 and/or the first water supply flow path 327.

Wash water supplied through the preliminary water supply flow path 331 is supplied to the preliminary detergent input box 329 through the preliminary water supply line connection part 324 and the preliminary water supply flow path 331 and supplied to the preliminary detergent input box 329 through the overflow projections 332*a* formed on the second circulation flow path 332 (with reference to FIG. 9).

The subsidiary detergent part water supply flow path 333 is connected to the subsidiary detergent part 336 through the connection flow path or channel 335 formed at the connection part 334.

The fabric softener input box or well 342 into which a fabric softener is provided and the bleaching agent input box or well 339 into which a bleaching agent is input are formed at the subsidiary detergent part 336. Overflow holes 341 (which the fabric softener, the bleaching agent, and wash water input into the fabric softener input box 342 and the bleaching agent input box 339 overflow) are formed at the upper portions of the fabric softener input box 342 and the bleaching agent input box 339. Siphons 344 (to supply the fabric softener to the fabric softener input box 342 and to supply bleaching agent to the bleaching agent input box 339) are formed at the lower portions of the fabric softener input box 342 and the bleaching agent input box 339. The siphons 344 are well known in the art and a detailed description thereof will thus be omitted.

Figure 10:
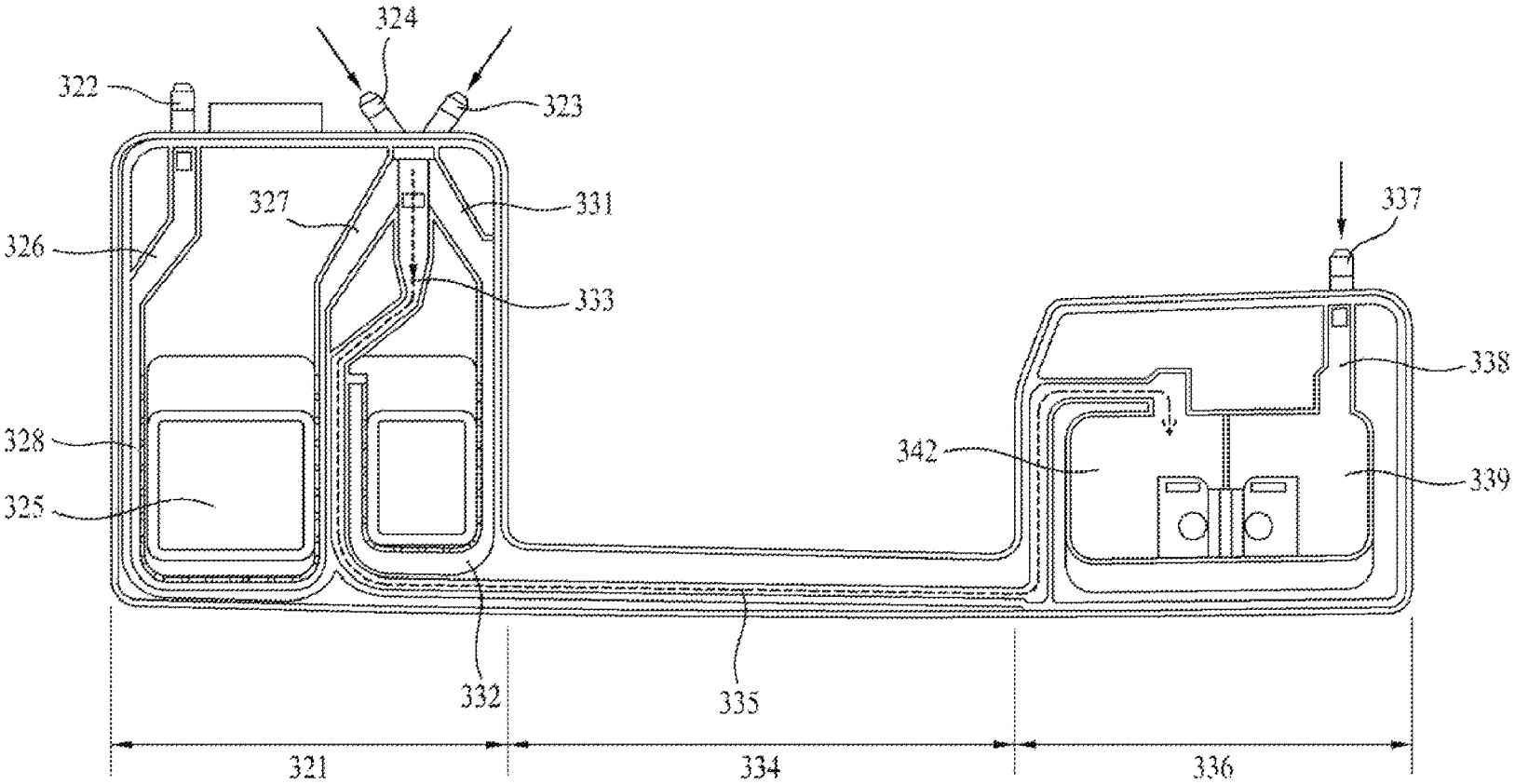

The connection flow path 335 formed at the connection part 334 extends to the fabric softener input box 342. Wash water supplied form the preliminary water supply line 135*c* is supplied to the fabric softener input box 342 through the preliminary water supply line connection part 324, the subsidiary detergent part water supply flow path 331, and the connection flow path 335 of the connection part 334 (with reference to FIG. 10).

A second water supply line connection part or inlet 337 (to which the second water supply line 135*b* is connected) is provided at the rear portion of the bleaching agent input box 339. A second water supply flow path or channel 338 guides wash water to the bleaching agent input box 339 and is formed at the second water supply line connection part 337. Wash water supplied from the second water supply line 135*b* is supplied to the bleaching agent input box 339 through the second water supply line connection part 337 and the second water supply flow path 338 (with reference to FIG. 10).

The collector unit or a well tray 360 is located under the flow path unit 320 and serves to supply various detergents and subsidiary detergents input into the detergent input box 325, the preliminary detergent input box 329, the fabric softener input box 342, and the bleaching agent input box 339 of the flow path unit 320 together with supplied wash water to the tub 130.

The collector unit 360 includes the detergent collector part or well 361 provided with a discharge hole 363 through which the collected detergent and wash water are discharged to the tub 130, the subsidiary detergent collector part or well 367 in which the fabric softener and the bleaching agent are collected, and the inclined flow path or channel 364 connecting the detergent collector part 361 and the subsidiary detergent collector part 367. The detergent collector part 361, the subsidiary detergent collector part 367, and the inclined flow path 364 are formed integrally.

Further, the above-described duct space part or recess 315 is formed between the detergent collector part 361 and the subsidiary detergent collector part 367. The detergent collector part 361 and the subsidiary detergent collector part 367 are connected by the inclined flow path 364.

The lower surfaces of the detergent collector part 361, the subsidiary detergent collector part 367, and the inclined flow path 364 are inclined. Detergents and wash water collected in the detergent collector part 361, the subsidiary detergent collector part 367, and the inclined flow path 364 may be supplied to the tub 130 through the discharge hole 363 provided on the detergent collector part 361 based on the inclination.

Figure 11:
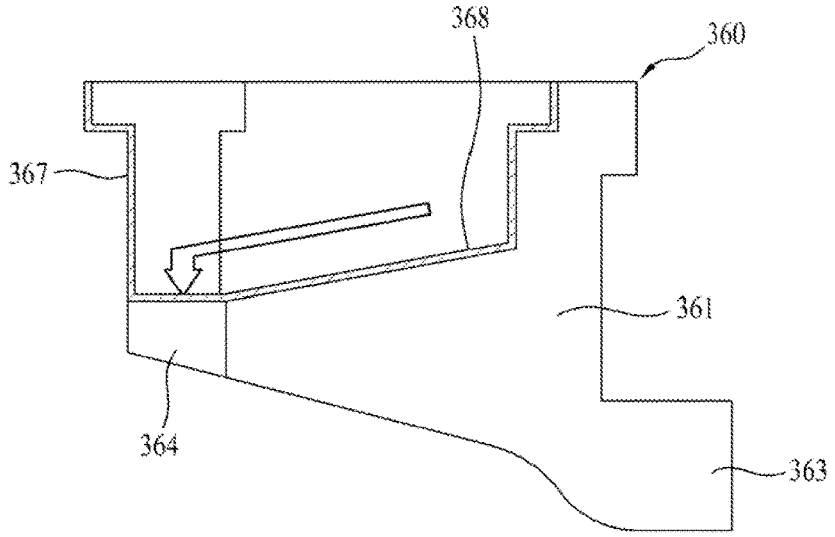
FIGS. 11 to 13 are cross-sectional views illustrating a collector unit of the detergent dispenser in accordance with the embodiment of the present disclosure.
Figure 12:
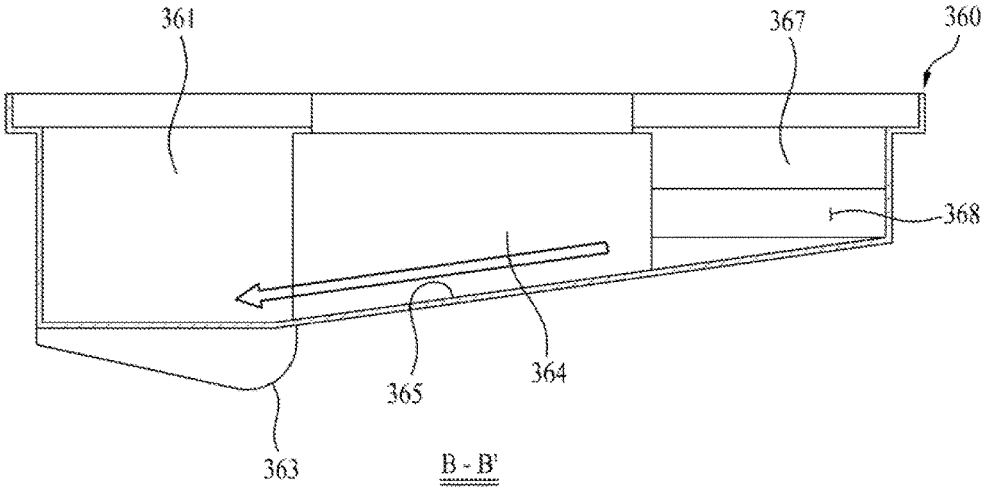
Figure 13:
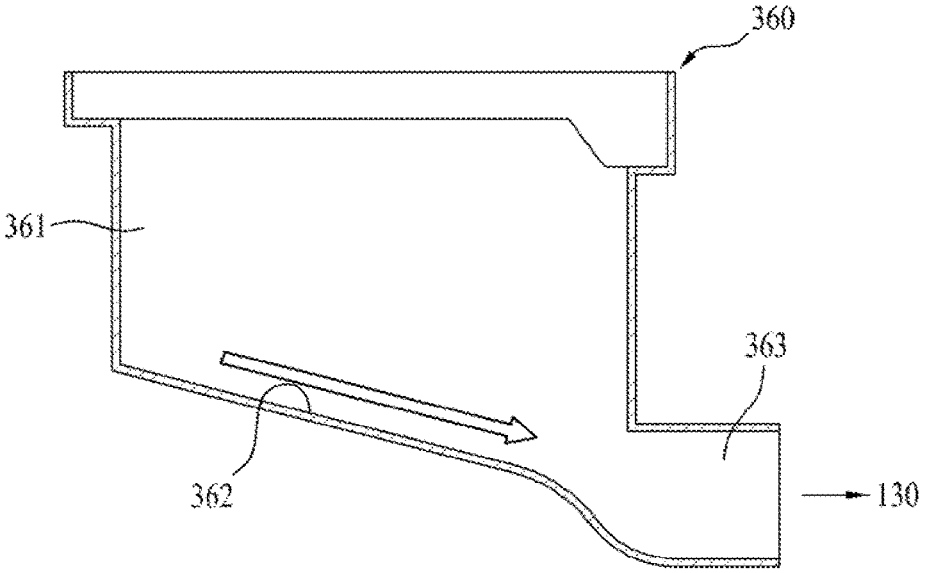

With reference to FIGS. 11 to 13, a first inclined surface 368 is inclined downward toward the inclined flow path 364 (connected to one side of the subsidiary detergent collector part 367) and is formed on the lower surface of the subsidiary detergent collector part 367. A second inclined surface 365 is inclined downward from the first inclined surface 368 of the subsidiary detergent collector part 367 toward the detergent collector part 361 and is formed on the lower surface of the inclined flow path 364. A third inclined surface 362 is inclined downward from the second inclined surface 365 of the inclined flow path 364 toward the discharge hole 363 and is formed on the lower surface of the detergent collector part 361.

Detergents provided into the detergent collector part 351 are discharged along the third inclined surface 362 of the detergent collector part 351 through the discharge hole 363 and provided into the tub 130. A fabric softener and a bleaching agent provided into the subsidiary detergent collector part 367 are introduced to the inclined flow path 364 along the first inclined surface 368 of the subsidiary detergent collector part 367. The fabric softener and the bleaching agent introduced to the inclined flow path 364 are introduced to the detergent collector part 361 along the second inclined surface 365 of the inclined flow path 364, discharged along the third inclined surface 362 of the detergent collector part 351 through the discharge hole 363, and provided into the tub 13.

Figure 14:
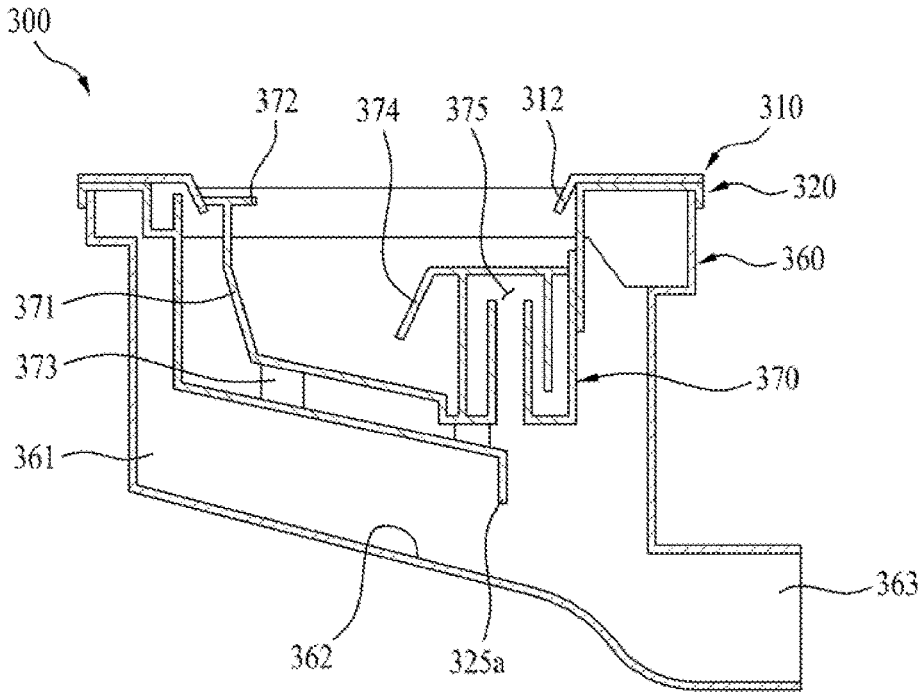
FIG. 14 is a cross-sectional view illustrating the internal structure of the detergent dispenser in accordance with the embodiment of the present disclosure.

As shown in FIG. 14, the detergent dispenser 300 in accordance with the present disclosure includes a liquid detergent input guide 370 to input a liquid detergent. In case of the detergent dispenser 300 including the lid unit 310, the flow path unit 320, and the collector unit 360, the liquid detergent together with wash water is supplied directly to the tub 130 if a liquid detergent is input directly to the detergent input box 325, and may thus be supplied at an undesired time. Therefore, the liquid detergent input guide 370 to supply the liquid detergent using siphonage is required so as to adjust input of the liquid detergent.

To prevent undesired time introduction of the liquid detergent, the liquid detergent input guide 370 includes a liquid detergent reservoir 371 separably mounted in the detergent input box 325 of the flow path unit 320 and storing a liquid detergent. A liquid detergent siphon 375 supplies the liquid detergent stored in the liquid detergent reservoir 371 using siphonage. The siphon 375 is provided on the inner surface of the liquid detergent reservoir 371.

A handle 372 to attach or detach the liquid detergent input guide 370 to or from the detergent dispenser 300 is provided at one side of the liquid detergent reservoir 371. An input boundary protrusion 374 restricts the input amount of the liquid detergent and is provided at one side of the liquid detergent siphon 375. A plurality of support protrusions 373 supports the liquid detergent input guide 370 when the liquid detergent input guide 370 is mounted in the detergent input box 325 and is provided on the lower surface of the liquid detergent input guide 370.

Figure 15:
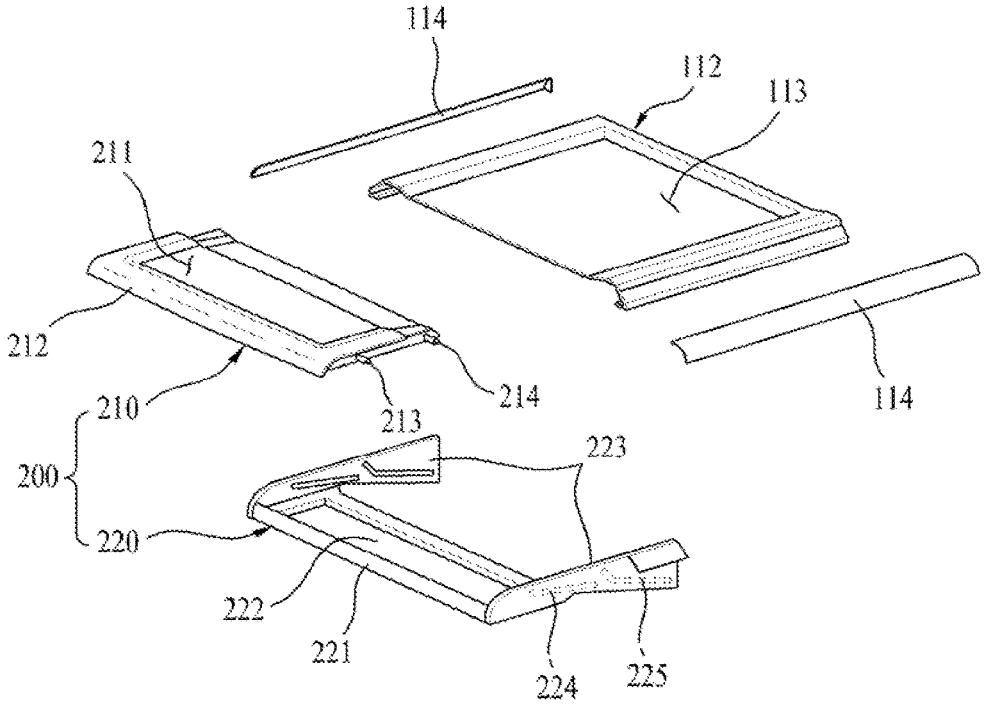
FIG. 15 is an exploded perspective view illustrating an upper panel and a dispenser cover of a washing machine in accordance with one embodiment of the present disclosure.

As shown in FIG. 15, the dispenser cover 200 in accordance the embodiment of the present disclosure includes a door bracket 220 installed above the detergent dispenser 300 (which is installed within the washing machine 100) and a sliding door 210, which is guided by the door bracket 220. When the sliding door 210 is opened, the sliding door 210 moves to an area below the upper cover 112 to allow access to the detergent dispenser 300. The detergent dispenser 300 and the upper cover 112 are separated from each other by a designated interval so as to move the sliding door 210 of the dispenser cover 200.

The sliding door 210 is located on the upper surface of the front portion of the washing machine 100, i.e., the front portion of the upper cover 112, so as to be exposed. Further, the outer surface of the sliding door 210 extends to the upper surface of the upper cover 112. That is, the depression surface 113 to increase strength of the upper cover 112 is formed on the upper surface of the upper cover 112, and a depression surface 211 extending to the depression surface 112 of the upper cover 112 is formed on the upper surface of the sliding door 210. Therefore, the upper surface of the washing machine 100 has one depressed shape formed by the depression surface 113 of the upper cover 112 and the depression surface 211 of the sliding door 210.

Further, a connection surface 212 extending along the outer shape of the front cover 117 of the cabinet 110 is formed at the front edge of the sliding door 210. The front edge of the sliding door 210 forms the upper edge of the front surface of the washing machine 100. The connection surface 212 (formed as a designated curved surface) may be formed at the front edge of the sliding door 210, and the upper surface of the sliding door 210 and the front surface of the front cover 117 are smoothly connected by the curved connection surface 212.

However, the connection surface 212 of the sliding door 210 may be formed as an inclined surface having a designated angle. If the front edge of the sliding door 210 is formed as an inclined surface, the front edge of the washing machine 100 may be formed by three flat surfaces or curved surfaces including the sliding door 210, the connection surface 212, and the front cover 117.

First and second sliding protrusions 213 and 214 are guided by the door bracket 220, and are formed at both sides of the sliding door 210. The first and second sliding protrusions 213 and 214 are separated by a designated or prescribed interval, and the second sliding protrusions 214 are formed behind the first sliding protrusions 213. The door bracket 220 includes a body 221 located above the detergent dispenser 300 and guides or guide parts 223 located at both side ends of the body 221 to allow guiding of the sliding door 210. One through hole 222 (or a plurality of through holes 222, corresponding to the detergent input hole 312, the preliminary detergent input hole 313, and the subsidiary detergent input hole 317 formed on the detergent dispenser 300), is formed on the body 221.

A pair of guide parts 223 is formed in a shape perpendicular to both ends of the body 221 and extends to a designated length toward an area below the upper cover 112. First and second guide slits 224 and 225 (into which the first and second sliding protrusions 213 and 214 of the sliding door 210 are inserted so as to be guided), are formed on the opposite inner surfaces of the guide parts 223.

The first and second guide slits or grooves 224 and 224 are symmetrically formed on the opposite inner surfaces of the guide parts 223 in a pair. The first guide slits 224 are located in front of the second guide slits 225. Further, the first guide slits 224 and the second guide slits 225 have different incline gradients, and the first and second guide slits 224 and 225 are inclined downward as they move toward the upper cover 112. The second guide slits 225 may be a greater gradient than the first guide slits 224.

The first sliding protrusions 213 are inserted into the first guide slits 224 and the second sliding protrusions 214 are inserted into the second guide slits 225. Therefore, when the sliding door 210 slides, the first and second sliding protrusions 213 and 214 are moved along the first and second guide slits 224 and 225.

The first guide slits 224 and the second guide slits 225 are formed with different gradients, and the upper ends of the first and second guide slits 224 and 225 extend to a position where the sliding door 210 closes the detergent dispenser 300 when the first and second sliding protrusions 213 and 214 combined with the first and second guide slits 224 and 225 are located at the upper ends of the first and second guide slits 224 and 225. See FIG. 16.

The lower ends of the first and second guide slits 224 and 225 extend to a position where the sliding door 210 opens the detergent dispenser 300 and is moved to an area below the upper cover 112 when the first and second sliding protrusions 213 and 214 combined with the first and second guide slits 224 and 225 are located at the lower ends of the first and second guide slits 224 and 225. See FIG. 16.

Figure 16:
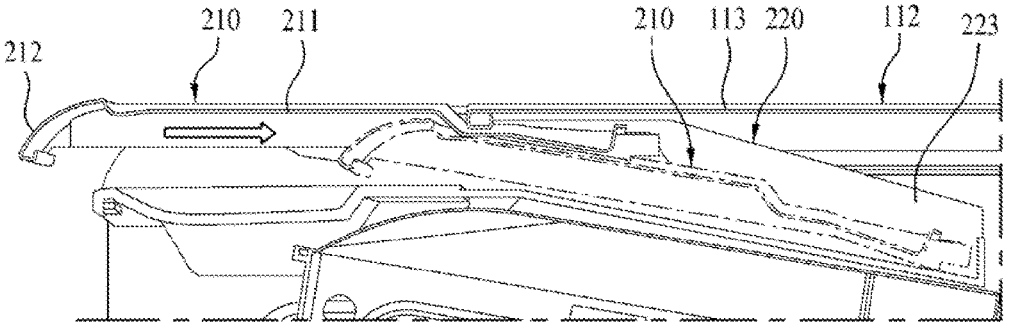
FIG. 16 is a partial cross-sectional view of the dispenser cover in accordance with the embodiment of the present disclosure.
Figure 17:
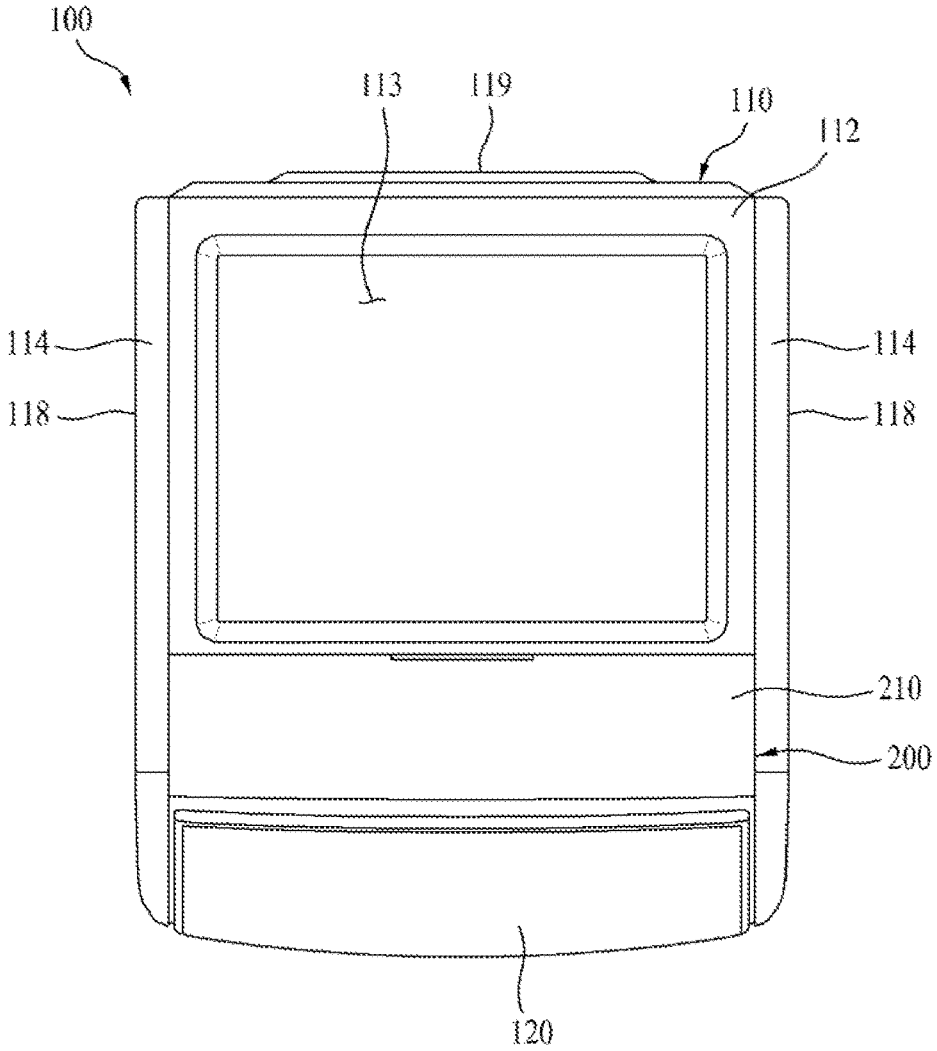
FIGS. 17 and 18 are plan views illustrating operation of the dispenser cover in accordance with the embodiment of the present disclosure.

As shown in FIGS. 16 and 17, the disperser cover 200 closes the detergent dispenser 300 in the initial state of the dispenser cover 200. The sliding door 210 of the dispenser cover 200 is withdrawn from the area below the upper cover 112 and is located on the upper surface of the detergent dispenser 300.

At this time, the first and second sliding protrusions 213 and 214 formed at both sides of the sliding door 210 are located at the upper ends of the first and second guide slits 224 and 225 formed on the guide parts 223 of the door bracket 220. The front edge of the sliding door 210 forms the upper edge of the front surface of the washing machine 100.

Figure 18:
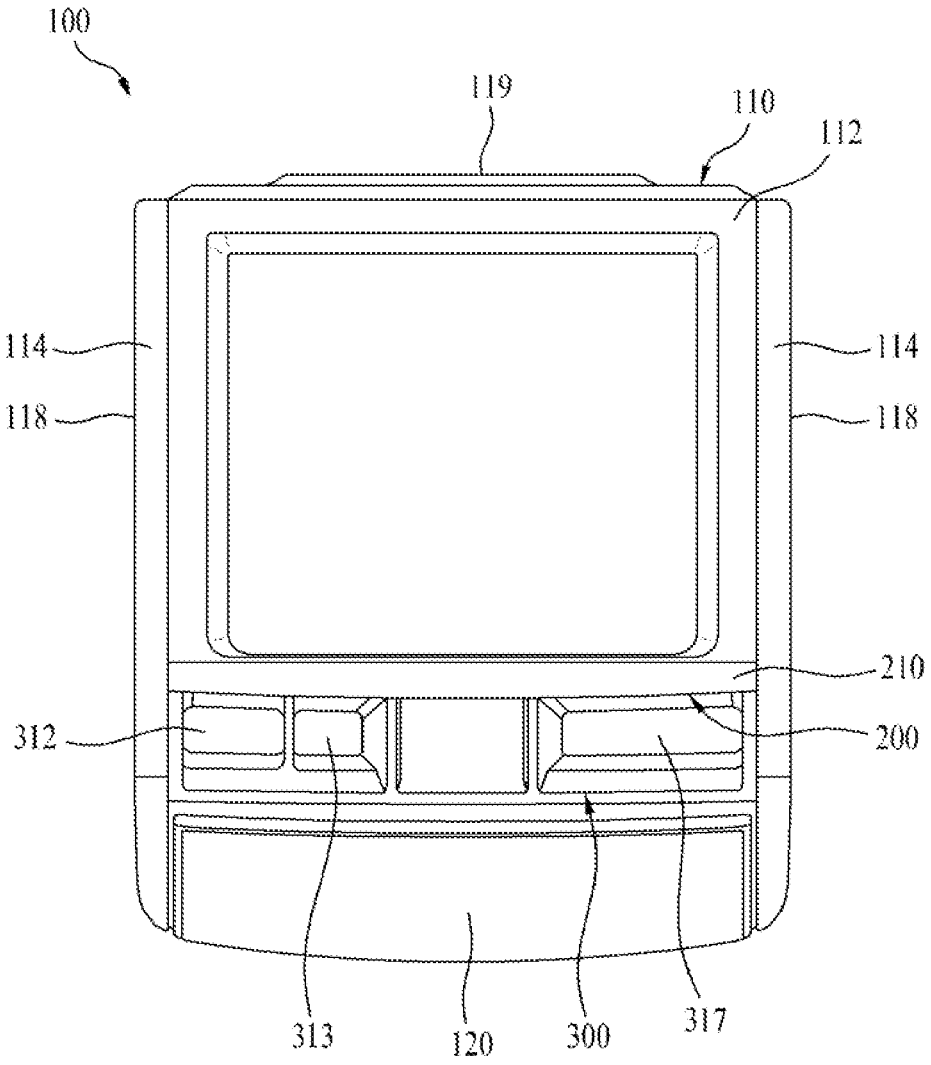

As shown in FIGS. 16 and 18, the sliding door 210 of the dispenser cover 200 is pushed toward the upper cover 112, in order to open the detergent dispenser 300. The first and second sliding protrusions 213 and 214 of the sliding door 210 are moved along the first and second guide slits 224 and 225 formed on the guide parts 223 of the door bracket 220 and thus, the sliding door 210 is moved. Since the first and second guide slits 224 and 225 are inclined downward as they move toward the upper cover 112, the sliding door 210 is moved and inserted into the area below the upper cover 112 and thus opens the detergent dispenser 300.

Figure 19:
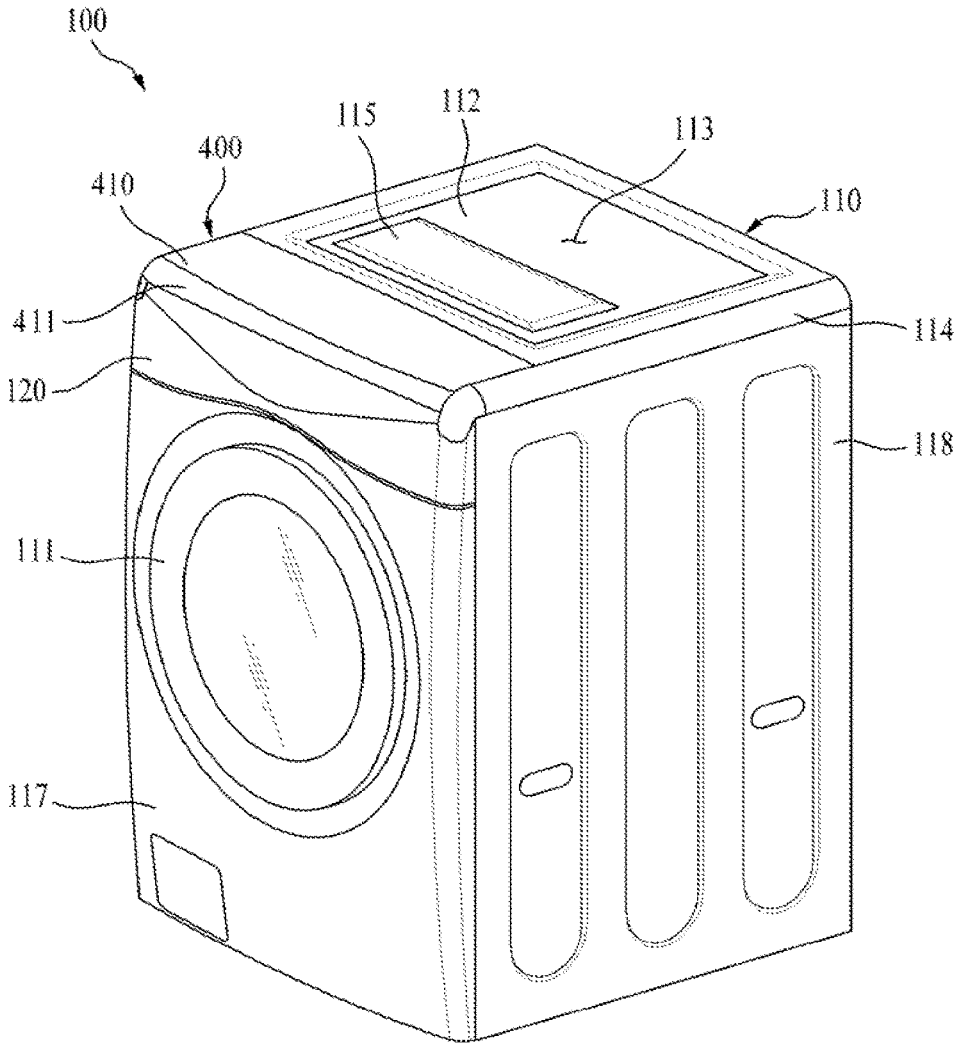
FIG. 19 is a perspective view illustrating a washing machine to which a dispenser cover in accordance with another embodiment of the present disclosure is applied.

FIG. 19 is a perspective view illustrating a washing machine having a dispenser cover 400 in accordance with another embodiment. A detergent dispenser 300 to provide detergents is installed at the upper region of the front portion of the inside of the washing machine 100. The rear portion of the upper surface of the washing machine 100 is formed by an upper cover 112. The dispenser cover 400 is rotated to the outside of the washing machine 100 to open and close the detergent dispenser 300 and is provided at the front portion of the upper surface of the washing machine 100 (particularly, an area above the detergent dispenser 300).

Further, the upper cover 112 and the dispenser cover 400 form the upper surface of the washing machine 100 have the same extension surface for uniformity. The dispenser cover 400 adjacent to the upper cover 112 forms an extension surface extending to the upper surface of the upper cover 112 when the detergent dispenser 300 is closed. Further, side panels 114 located at both sides of the upper cover 112 extend in the direction of the dispenser cover 400 and thus finish both sides of the upper cover 112 and the dispenser cover 400.

The dispenser cover 400 forms both the front portion of the upper surface of the washing machine 100 and extends so as to be continued to the front cover 117 of the washing machine. The dispenser cover 400 forms a part of the upper surface of the washing machine 100 and the upper surface and the front surface of the washing machine 100 are smoothly connected by a connection surface 311 extending to the front cover 117 of the washing machine 100.

Figure 20:
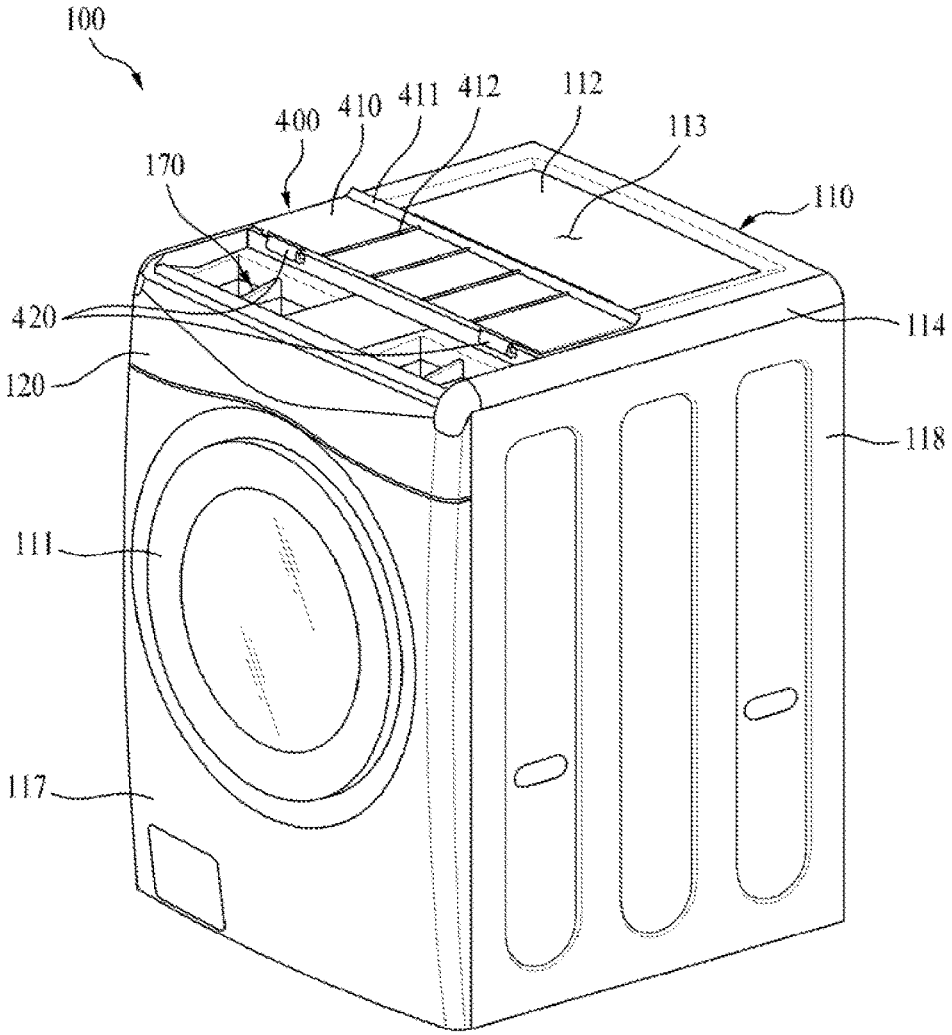
FIG. 20 is a perspective view illustrating an opened state of the dispenser cover in accordance with the embodiment of the present disclosure.

As shown in FIG. 20, the dispenser cover 400 includes hinges 420 rotatably provided at the front portion of the upper cover 112 of the washing machine 100 and a door 410 coupled to the hinges 420 to rotate to the outside of the washing machine 100 to allow access to the detergent dispenser 300. The rotatable door 410 is located on the upper surface of the front portion of the washing machine 100, i.e., the front portion of the upper cover 112, so as to be exposed. Further, the outer surface of the sliding door 410 extends to the upper surface of the upper cover 112. A depression surface 113 to increase strength of the upper cover 112 is formed on the upper surface of the upper cover 112, and a protruding part 115 to support the rotatable door 410 when the rotatable door 410 is opened is formed at a designated portion of the depression surface 113.

A connection surface 411 extending along the outer shape of the front cover 117 of the cabinet 110 is formed at the front edge of the rotatable door 410. The front edge of the rotatable door 410 forms the upper edge of the front surface of the washing machine 100. The connection surface 411 (formed as a designated curved surface) may be formed at the front edge of the rotatable door 410, and the upper surface of the rotatable door 410 and the front surface of the front cover 117 are smoothly connected by the curved connection surface 311.

However, the connection surface 411 of the rotatable door 410 may be formed as an inclined surface having a designated angle. If the front edge of the rotatable door 410 is formed as an inclined surface, the front edge of the washing machine 100 may be formed by three flat surfaces or curved surfaces including the rotatable door 410, the connection surface 411, and the front cover 117.

A plurality of reinforcing ribs 412 to increase strength of the rotatable door 410 is formed on the inner surface of the rotatable door 410. The reinforcing ribs 412 also guide a detergent container in which detergents are stored when the detergents are input into the detergent dispenser 300. The reinforcing ribs 412 may be formed between input holes, such as a detergent input hole 312, a preliminary detergent input hole 313, and a subsidiary detergent input hole 317 formed on the detergent dispenser 300.

Figure 21:
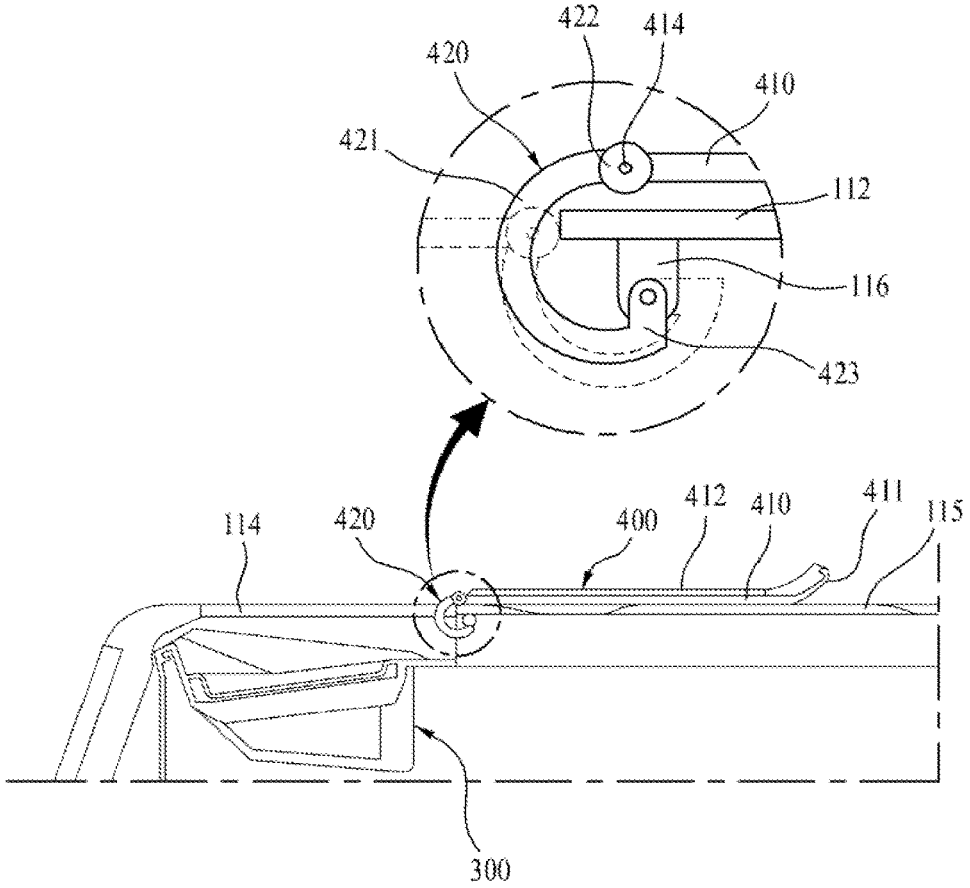
FIG. 21 is a partial cross-sectional view illustrating the dispenser cover in accordance with the embodiment of the present disclosure.

As shown in FIG. 21, the rotatable hinges 420 are rotatably combined with the rotatable door 410 and the upper cover 117, respectively. For this purpose, hinge parts 414 with which one side of each rotatable hinge 420 is rotatably combined are formed at the rear portion of the rotatable door 410, and hinge brackets 116 with which the other side of each rotatable hinge 320 is rotatably combined are provided on the lower surface of the front portion of the upper cover 112.

The rotatable hinge 420 includes an annular body 421 having an arc-shaped cross-section, one side of which is opened, a door connection terminal 422 formed at one side of the annular body 421 so that the rotatable door 410 is connected to the door connection terminal 422, and an upper cover connection terminal 423 formed at the other side of the annular body 421 so that the upper cover 112 is rotatably connected to the upper cover connection terminal 423. Therefore, the rotatable door 410 is rotated about two rotary axes.

Figure 22:
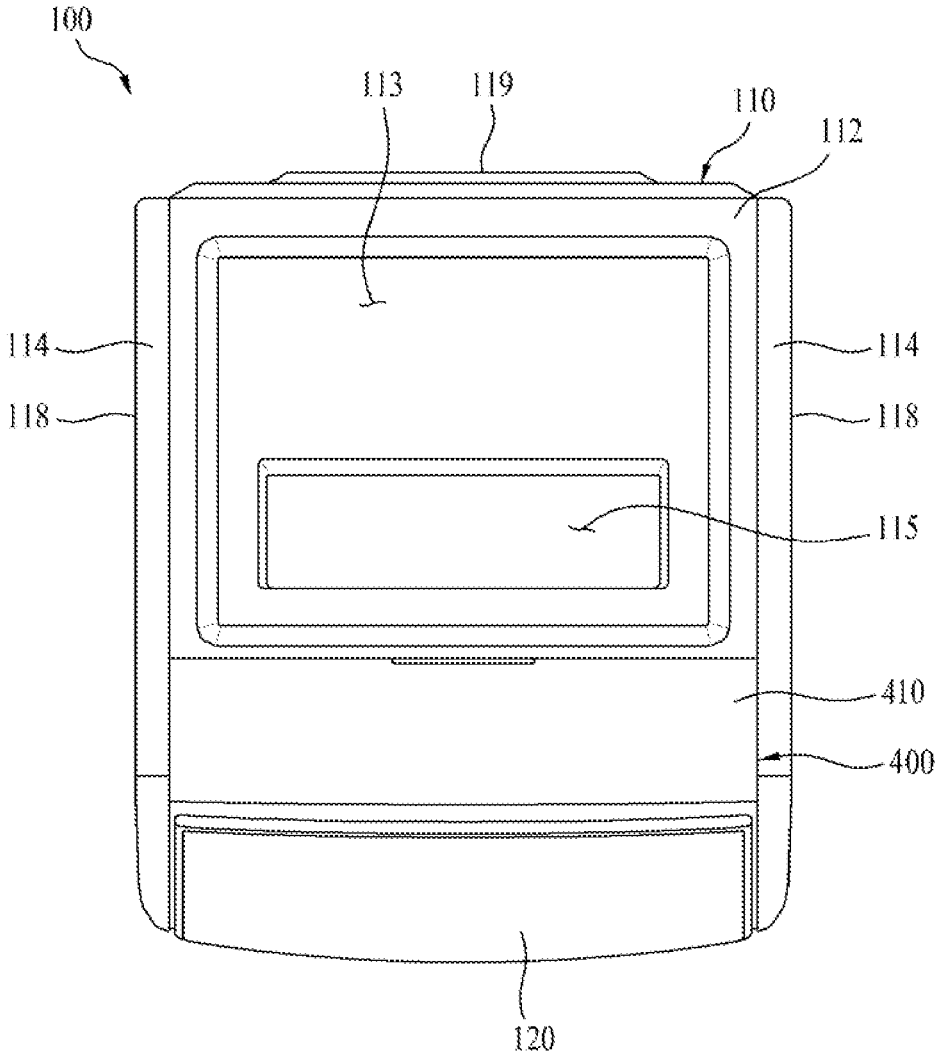
FIGS. 22 and 23 are plan views illustrating operation of the dispenser cover in accordance with the embodiment of the present disclosure.
Figure 23:
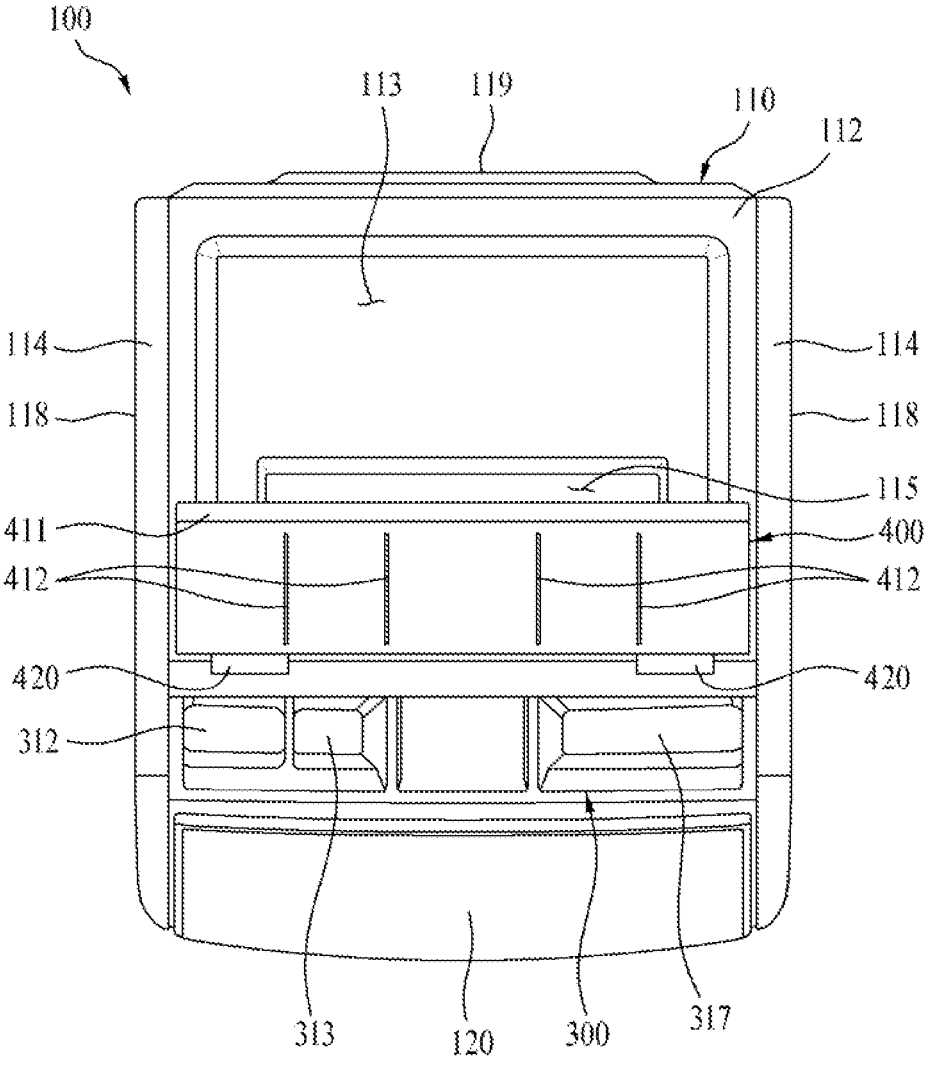

As shown in FIG. 21, when the detergent dispenser 300 is closed, the rotatable door 410 and the hinge brackets 116 rotatably combined with the rotatable hinges 420 are rotated and the upper cover 112 and the rotatable door 410 form the same flat surface (see also FIG. 22). Further, when the detergent dispenser 300 is opened, the rotatable door 410 and the hinge brackets 116 rotatably combined with the rotatable hinges 420 are rotated and the upper surface of the rotatable door 410 is attached to the protruding part 115 of the upper cover 112 and thus supported (see also FIG. 23).

In the above-described washing machine 100 in accordance with the embodiment of the present disclosure, the detergent dispenser 300 is located on the upper surface of the washing machine 100 and the dispenser cover 200 or 400 opening and closing the detergent dispenser 300 is formed on the upper surface of the washing machine 100 and thus, a user may more easily and conveniently input detergents into the detergent dispenser 300.

Further, in the above-described washing machine 100 in accordance with the embodiment of the present disclosure, the detergent part 321 and the subsidiary detergent part 336 of the detergent dispenser 300 are divided and thus provide high visibility to a user in terms of input of detergents and subsidiary detergents.

Further, the upper cover 112 and the dispenser cover 200 or 400 forming the upper surface of the washing machine 100 are continuously formed and thus, the upper surface of the washing machine 100 may have 3D effects.

As apparent from the above description, in a washing machine in accordance with one embodiment of the present disclosure, the position and structure of a detergent dispenser are improved so that a user may conveniently and easily input detergents to the detergent dispenser.

Further, in the washing machine in accordance with the embodiment of the present disclosure, the position and structure of the detergent dispenser are improved so that limitations as to the design of the washing machine may be reduced.

A washer/dryer combination laundry apparatus has been described. As can be appreciated, the present disclosure is readily applicable to a stand alone washing machine.

Accordingly, the present disclosure is directed to a washing machine that substantially obviates one or more problems due to limitations and disadvantages of the related art.

An object of the present disclosure is to provide a washing machine in which the position and structure of a detergent dispenser are improved so that a user may conveniently and easily input detergents to the detergent dispenser.

Another object of the present disclosure is to provide a washing machine in which the position and structure of a detergent dispenser are improved so that limitations as to the design of the washing machine may be reduced.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a washing machine includes a cabinet, a tub provided within the cabinet, a drum rotatably provided within the tub, an air supply device provided on the upper surface of the tub and circulating air to the center of the front portion of the tub, a detergent dispenser located above the front portion of the tub and separating a detergent part to input detergents and a subsidiary detergent part to input subsidiary detergents, and a dispenser cover opening and closing the upper surface of the detergent dispenser.

The cabinet may include an upper cover forming the rear portion of the upper surface of the cabinet and exposing the front portion of the upper surface of the cabinet, and the detergent dispenser may be located at the front portion of the upper surface of the cabinet exposed by the upper cover.

The detergent part and the subsidiary detergent part of the detergent dispenser may be formed integrally, and a space part in which a part of the air supply device may be located is formed.

The detergent part and the subsidiary detergent part of the detergent dispenser may be separated by a designated interval, and a connection part connecting the detergent part and the subsidiary detergent part and having a space part in which a part of the air supply device is located may be further provided.

Water supply lines to supply wash water mixed with the detergents input into the detergent part may be connected to the detergent part, and wash water may be supplied to the subsidiary detergent part through the connection part.

The connection part may include a connection flow path guiding wash water to the subsidiary detergent part.

The subsidiary detergents input into the subsidiary detergent part together with the wash water may be moved to the detergent part through the connection part.

The detergent part may include detergent input boxes into which the detergents are input, and the subsidiary detergent part may include subsidiary detergent input boxes into which the subsidiary detergents are input.

The subsidiary detergent part may receive wash water separately from the detergent part.

The detergent part may include a detergent input box into which a detergent is input and a preliminary detergent input box into which a preliminary detergent is input separately from the detergent.

A first water supply flow path to supply wash water to the detergent input box, a preliminary water supply flow path, intersecting the first water supply flow path, to supply wash water to the preliminary detergent input box, and a subsidiary detergent part water supply flow path guiding wash water to the subsidiary detergent part when the first water supply flow path and the preliminary water supply flow path simultaneously supply wash water may be formed.

A hot water line to supply hot water may be connected to the detergent input box.

Circulation flow paths along which wash water flows may be formed at the upper portions of the detergent input box and/or the preliminary detergent input box, and overflow projections through which the wash water overflows may be formed on the circulation flow paths.

A liquid detergent input guide to input a liquid detergent using siphonage when the liquid detergent is input into the detergent input box may be provided in the detergent input box.

The detergent dispenser may include a lid unit having a plurality of input holes to input the detergents and the subsidiary detergents, a flow path unit selectively mixing wash water with the detergents and the subsidiary detergents input into the respective input holes and supplying the detergents and the subsidiary detergents mixed with the wash water, and a collector unit collecting the detergents and the subsidiary detergents supplied by the flow path unit and supplying the detergents and the subsidiary detergents to the tub.

A connection part forming a space part in which the air supply device is located may be formed at the center of each of the lid unit, the flow path unit, and the collector unit.

Water supply lines to supply wash water mixed with the detergents input into the detergent part may be connected to the flow path unit, and the wash water supplied from the water supply lines may be supplied to the subsidiary detergent part through the connection parts.

The wash water may be supplied to the subsidiary detergent part through the connection part of the flow path unit.

The subsidiary detergents input into the subsidiary detergent part may be moved to the detergent part through the connection part of the collector unit.

The dispenser cover may form the front portion of the upper surface and form the front edge of the upper surface.

The upper surface may include a single boundary line dividing the upper surface, the rear portion of the upper surface based on the single boundary line may be formed by the upper cover, and the front portion of the upper surface based on the single boundary line may be formed by the dispenser cover.

The dispenser cover may be inserted into an area below the upper cover when the dispenser cover is opened.

The dispenser cover may include a door bracket located above the detergent dispenser and a sliding door combined with the door bracket so as to be slidable and opening and closing the detergent dispenser according to sliding.

The door bracket may include a body having a through hole to input the detergents to the detergent dispenser and guide parts formed at both sides of the body and having first and second guide slits guiding the sliding door, and first and second sliding protrusions inserted into the first and second guide slits are formed at both sides of the sliding door.

The first and second guide slits may be inclined downward in the moving direction of the sliding door.

The gradient of the second guide slits may be greater than the gradient of the first guide slits.

A depression part may be formed at the front portion of the upper surface of the upper cover and a depression part extending to the depression part of the upper cover may be formed at the rear portion of the upper surface of the sliding door.

The front edge of the sliding door may form the front edge of the cabinet, and a connection surface connecting the upper surface of the sliding door and a front cover of the cabinet may be formed.

The connection surface may be formed as one selected from a curved surface and a flat surface.

In another aspect of the present disclosure, a washing machine includes a cabinet including an upper cover forming the rear portion of the upper surface of the cabinet and exposing the front portion of the upper surface of the cabinet, a tub provided within the cabinet, a drum rotatably provided within the tub, an air supply device provided on the upper surface of the tub and circulating air to the center of the front portion of the tub, a detergent dispenser located above the front portion of the tub and located at the front portion of the upper surface of the cabinet exposed by the upper cover, and a dispenser cover opening and closing the upper surface of the detergent dispenser.

In yet another aspect of the present disclosure, a washing machine includes a cabinet, a tub provided within the cabinet, a drum rotatably provided within the tub, an air supply device provided on the upper surface of the tub and circulating air to the center of the front portion of the tub, a detergent dispenser including a detergent part located at one side of the air supply device to input detergents, a subsidiary detergent part located at the other side of the air supply device to input subsidiary detergents, and a connection part connecting the detergent part and the subsidiary detergent part, and a dispenser cover opening and closing the upper surface of the detergent dispenser.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

What is claimed is:

1. A laundry apparatus comprising:

a cabinet comprising:

a front surface comprising a door and a control panel mounted above the door;

a top surface comprising an upper rear portion and an upper front portion that forms a detergent dispenser cover and the upper front portion can open independently from the upper rear portion, the top surface having a boundary line dividing the upper rear portion from the upper front portion;

a left side cover and a right side cover that respectively form a left side surface and a right side surface of the cabinet; and a rear cover that forms a rear surface of the cabinet;

a tub provided within the cabinet;

a drum rotatably provided within the tub;

a detergent dispenser provided below the detergent dispenser cover and in communication with the tub, the detergent dispenser comprising:

a lid comprising a first portion having a first detergent input hole disposed at a first side of the lid adjacent to the left side cover and a second portion having a subsidiary detergent input hole disposed at a second side of the lid adjacent to the right side cover;

a flow path unit provided below the lid, the flow path unit comprising a first flow path in communication with the first portion and a subsidiary flow path separated from the first flow path and in communication with the subsidiary portion; and the collector unit comprising a first collector in communication with the first flow path, and a subsidiary collector in communication with the subsidiary flow path; and a first water supply line to supply water to the first flow path and a second water supply line to supply water to the subsidiary flow path, wherein the first collector supplies the water supplied by the first water supply line to the tub, and the subsidiary collector supplies the water supplied by the second water supply line to the tub.

2. The laundry apparatus of claim 1, wherein the subsidiary detergent input hole comprises a second detergent input hole and a third detergent input hole, wherein the subsidiary collector unit comprises a second collector in communication with the second detergent input hole and a third collector in communication with the third detergent input hole, and wherein the subsidiary flow path comprises a second flow path in communication with the second collector and a third flow path in communication with the third collector, whereby the second water supply line supplies water to the second flow path and a third water supply line supplies water to the third flow path.

3. The laundry apparatus of claim 2, wherein the first detergent input hole is located below a left side corner of the upper front portion of the top surface of the cabinet, and the second and the third detergent input holes are each disposed below a right side corner of the upper front portion of the top surface of the cabinet.

4. The laundry apparatus of claim 3, wherein the second and third collector units together have a single outlet in communication with the tub.

5. The laundry apparatus of claim 1, wherein the first detergent input hole is located below a left side corner of the upper front portion of the top surface of the cabinet, and the subsidiary detergent input hole is located below a right side corner of the upper front portion of the top surface of the cabinet.

6. The laundry apparatus of claim 5, wherein the detergent dispenser comprises a first detergent part and a subsidiary detergent part that are spaced apart from each other by a predetermined interval, whereby the first detergent part comprises the first flow path and the first collector, and the subsidiary detergent part comprises the subsidiary flow path and the subsidiary collector.

7. The laundry apparatus of claim 6, wherein the first portion of the lid comprises a first inclined part that is downwardly inclined toward the first detergent input hole, and wherein the subsidiary portion of the lid comprises a subsidiary inclined part that is downwardly inclined toward the subsidiary detergent input hole.

8. The laundry apparatus of claim 7, wherein the first detergent part receives water separately from the subsidiary detergent part.

9. The laundry apparatus of claim 8, wherein a hot water line to supply hot water is connected to the first detergent part.

10. The laundry apparatus of claim 9, wherein the lid forms a top surface of the collector unit.

11. The laundry apparatus of claim 10, wherein the flow path unit and the collector unit are integrally formed.

12. The laundry apparatus of claim 11, wherein a detergent input guide to input a detergent using siphonage when the detergent is provided into the first connector is provided in the first collector.

13. The laundry apparatus of claim 12, wherein the first collector comprises a well into which a detergent is provided, and the second collector comprises a subsidiary well into which a subsidiary detergent is provided.

14. The laundry apparatus of claim 13, wherein the detergent comprises at least one of liquid detergent, a powder detergent, a subsidiary detergent, a bleaching agent, and a fabric softener.

15. The laundry apparatus of claim 14, wherein the subsidiary collector unit has a single outlet in communication with the tub.

16. The laundry apparatus of claim 1, wherein the detergent dispenser cover is configured to rotate about the left and right side covers of the cabinet.

17. The laundry apparatus of claim 1, wherein the detergent dispenser cover forms a front edge of the top surface.

18. The laundry apparatus of claim 17, wherein a front edge of the detergent dispenser door forms a front edge of the top surface of the cabinet, and an upper edge of the control panel forms an upper edge of the front surface of the cabinet.

19. The laundry apparatus of claim 18, further comprising:

a connection surface extending from the front edge of the detergent dispenser door to the upper edge of the control panel.

20. The laundry apparatus of claim 1, wherein the subsidiary detergent input hole is a second detergent input hole.

21. A laundry apparatus comprising:

a cabinet comprising:

a front surface comprising a door;

a top surface comprising an upper rear portion and an upper front portion that forms a detergent dispenser cover and the upper front portion can open independently from the upper rear portion, the top surface having a boundary line dividing the upper rear portion from the upper front portion;

a left side cover and a right side cover that respectively form a left side surface and a right side surface of the cabinet; and a rear cover that forms a rear surface of the cabinet;

a tub provided within the cabinet;

a drum rotatably provided within the tub;

a detergent dispenser provided below the detergent dispenser cover and in communication with the tub, the detergent dispenser comprising:

a lid comprising a first portion having a first detergent input hole disposed at a first side of the lid adjacent to the left side cover and a second portion having a subsidiary detergent input hole disposed at a second side of the lid adjacent to the right side cover;

a flow path unit provided below the lid, the flow path unit comprising a first flow path in communication with the first portion and a subsidiary flow path separated from the first flow path and in communication with the subsidiary portion; and a collector unit comprising a first collector in communication with the first flow path, and a subsidiary collector in communication with the subsidiary flow path; and a first water supply line to supply water to the first flow path and a second water supply line to supply water to the subsidiary flow path, wherein the first collector supplies the water supplied by the first water supply line to the tub, and the subsidiary collector supplies the water supplied by the second water supply line to the tub.

22. A laundry apparatus comprising:

a cabinet comprising:

a front surface comprising a door;

a top surface comprising an upper rear portion and an upper front portion that forms a detergent dispenser cover and the upper front portion can open independently from the upper rear portion, the top surface having a boundary line dividing the upper rear portion from the upper front portion;

a left side cover and a right side cover that respectively form a left side surface and a right side surface of the cabinet; and a rear cover that forms a rear surface of the cabinet;

a tub provided within the cabinet;

a drum rotatably provided within the tub;

a detergent dispenser provided below the detergent dispenser cover and in communication with the tub, the detergent dispenser comprising:

a lid comprising a first portion having a first detergent input hole disposed at a first side of the lid adjacent to the left side cover and a second portion having a subsidiary detergent input hole disposed at a second side of the lid adjacent to the right side cover;

a flow path unit provided below the lid, the flow path unit comprising a first flow path in communication with the first portion and a subsidiary flow path separated from the first flow path and in communication with the subsidiary portion; and a collector unit comprising a first collector in communication with the first flow path, and a subsidiary collector in communication with the subsidiary flow path; and a first water supply line to supply water to the first flow path and a second water supply line to supply water to the subsidiary flow path, wherein the first collector supplies the water supplied by the first water supply line to the tub, and the subsidiary collector supplies the water supplied by the second water supply line to the tub, and wherein the flow path unit and the collector unit are integrally formed.

* * * * *